United States Patent [19]

Brennan

[11] Patent Number: 4,834,032

[45] Date of Patent: May 30, 1989

[54] TWO-STROKE CYCLE ENGINE AND PUMP HAVING THREE-STROKE CYCLE EFFECT

[75] Inventor: Joseph E. Brennan, Amesbury, Mass.

[73] Assignee: Union Machine Company of Lynn, Peabody, Mass.

[21] Appl. No.: 24,691

[22] Filed: Mar. 11, 1987

[51] Int. Cl.[4] ..... F02B 25/08

[52] U.S. Cl. ..... 123/51 BA; 123/53 C; 417/488; 417/498; 417/521

[58] Field of Search ..... 123/51 B, 51 BA, 53 C, 123/57 B, 59 BA, 59 BL, 70 V; 91/197; 417/488, 498, 521

[56] References Cited

U.S. PATENT DOCUMENTS

| | | | |
|---|---|---|---|
| 876,870 | 1/1908 | Gordon | 123/51 BA |
| 1,831,664 | 11/1931 | Hoch | 123/51 B X |
| 2,117,118 | 5/1938 | Pavlecka | 123/53 C X |
| 2,260,197 | 10/1941 | Seligman | 123/51 B |
| 3,198,179 | 8/1965 | Stephens | 123/51 B |
| 4,312,305 | 1/1982 | Noguchi et al. | 123/51 BA |

FOREIGN PATENT DOCUMENTS

| | | | |
|---|---|---|---|
| 866430 | 5/1941 | France | 123/51 BA |
| 555974 | 9/1943 | United Kingdom | 123/51 BA |
| 660411 | 11/1951 | United Kingdom | 123/51 BA |

*Primary Examiner*—Michael Koczo

[57] ABSTRACT

A multi-cylinder gas engine featuring a unique method of gas fuel intake and cylinder exhaust gas scavenging and recharging. It is a three cylinder opposed piston two-stroke cycle engine combined with a three cylinder opposed piston, sequentially ported, valveless pump to produce a three-stroke cycle engine effect. The engine has a positive compression, power, and recharge strokes, but no actual exhaust stroke. Exhaust is accomplished by pressure "blowdown" and by displacement scavenging of the cylinders during the recharge stroke. Operation may be based on the Otto cycle (gasoline or fuel, glow plug or spark ignition) or the diesel cycle and may utilize one or more carburetors or fuel injection. The firing order is sequential, in the same direction as crankshaft rotation, equally spaced (120 degrees), and results in three power strokes of approximately 120 degrees duration per revolution. A pump is also described.

20 Claims, 31 Drawing Sheets

(0 DEGREES)

(0 DEGREES)

(60 DEGREES)

(60 DEGREES)

(120 DEGREES)

(120 DEGREES)

(180 DEGREES)

(180 DEGREES)

(240 DEGREES)

(240 DEGREES)

(300 DEGREES)

(300 DEGREES)

(300 DEGREES)

TWO-STROKE CYCLE ENGINE AND PUMP HAVING THREE-STROKE CYCLE EFFECT

The invention relates to small engines of the two-stroke cycle type, e.g., as employed for outboard motors, lawn mowers, snow throwers, small tractors, and the like, and two-stroke cycle pumps.

Prior small two-stroke cycle engines typically worked by crankcase compression of a fuel-gas mixture, requiring that oil or other lubricant be mixed with the fuel; and the two-stroke cycle usually involves reciprocating action, resulting in unbalance or "shake".

SUMMARY OF THE INVENTION

According to one aspect of the invention, a two-stroke cycle engine having three-stroke cycle engine effect comprises: at least one set of first, second and third two-stroke cycle power cylinder-piston assemblies, each power cylinder-piston assembly incorporating two, horizontally opposed, reciprocating pistons, the set of power cylinder-piston assemblies arranged in triangular configuration and connected with each other so as to operate in synchronization with each other with a phase difference of about 120° therebetween; operatively associated with each set of power cylinder-piston assemblies, an integral set of first, second and third pump cylinder-piston assemblies, each pump cylinder-piston assembly incorporating two horizontally opposed, reciprocating pistons so as to define a central pump chamber, the set of pump cylinder-piston assemblies arranged in triangular configuration and driven by the set of power cylinder-piston assemblies in synchronization therewith with a phase difference; each power cylinder having an inlet port adjacent an axial end and an exhaust port adjacent an axial end for flow of exhaust gas from the cylinder during exhaust-recharge stroke, and each pump cylinder having first and second ports, each port adjacent an axial end of the cylinder, and a third port adjacent the mid-section of the cylinder; ignition means associated with each power cylinder-piston assembly; fluid manifold means interconnecting ports of the power and pump cylinders for flow of fluid therebetween; a set of first, second and third crank mechanisms operatively associated with pistons disposed within adjacent axial ends of pairs of power cylinder-piston assemblies and pairs of pump cylinder-piston assemblies; and timing means for drivingly connecting the set of crank mechanisms with each other so as to rotate in the same direction in synchronization with each other.

In preferred embodiments, the fluid manifold means comprises first conduit means connected to each first port of each pump cylinder for passage of fluid in sequence into the central pump chamber of the pump cylinder-piston assembly when the first port of each pump cylinder-piston assembly is open by movement of the opposed pistons therewithin, second conduit means connecting a second port of each pump cylinder to a third port of an adjacent pump cylinder-piston assembly when the second port of the first pump cylinder-piston assembly is opened by movement of the opposed pistons therewithin, and to an inlet port of a power cylinder-piston assembly. Preferably the engine further comprises a carburetor means, the first conduit means connecting the carburetor means to at least one first port of a pump cylinder for passage of gas-fuel mixture therebetween, and preferably the engine further comprises a flow control valve in at least one of the second conduit means, said valve adapted for short-circuiting fuel-gas mixture flow toward a power cylinder-piston assembly to an adjacent pump cylinder-piston assembly for reduced power operation; the triangular configuration of the set of power cylinder-piston assemblies is an equilateral triangle; the triangular configuration of the set of pump cylinder-piston assemblies is an equilateral triangle; the engine further comprises cooling means associated with the cylinder-piston assemblies, preferaby cooling fins or jackets; the crank mechanisms are housed within crankcases provided for containment of lubricating fluid about moving parts of the engine. Preferably all of the pistons disposed in the cylinder-piston assemblies have rear surfaces defining end pump chambers within axial end segments of the cylinders, and the engine further comprises conduit means interconnecting the crankcases for flow of lubricating fluid therebetween, whereby reciprocating movement of the pistons creates a pressure differential between adjacent crankcases that advances sequentially, during revolution, for pumping lubricating fluid between the crankcases; the first, second and third pump cylinder-piston assemblies are valveless; the inlet port and the outlet port of each power cylinder are disposed adjacent opposite axial ends of the power cylinder for axial scavenging flow of exhaust gas from the cylinder during exhaust-recharge stroke, preferably the inlet ports in the power cylinders have the form of circumferentially-extending grooves of limited arcuate extent for providing scavenging flow of fluid having a circumferential component of flow within the cylinders; the triangular configuration of the set of pump cylinder-piston assemblies coincides with the triangular configuration of the set of power cylinder-piston assemblies; the engine further comprises jackets or fins disposed about one or more of the cylinders for flow of cooling fluid thereabout; and the first and second ports of each pump cylinder are disposed adjacent opposite ends of the pump cylinder-piston assembly for axial flow of fluid therebetween.

There is thus provided a small two-stroke cycle engine having a three-stroke cycle effect, with the following advantages over the typical small two-stroke cycle engine utilizing crankcase compression:

- near perfect balance, by symmetry, of mutli-cylinder sequential firing, with no reciprocating unbalance ("shake");
- no oil or other lubricant required in the fuel, thereby lowering operating costs and reducing smoke and air pollution;
- increased volumetric efficiency due to positive displacement intake and positive displacement recharge strokes, and high cross scavenging of cylinder exhaust gas;
- lower pumping losses with no power wasted precompressing intake gas for recharge flow (intake gas is not compressed beyond the degree required to sustain flow);
- triangular arrangement of cylinders and frame, resulting in high strength and rigidity with minimal weight;
- simplicity of design and operation resulting in high reliability and durability;
- lower manufacturing costs due to identical design of multiple components; and
- in diesel, large engine potential, with reduced noise level compared to prior blower scavenged two-stroke cycle engines.

According to another aspect of the invention, a two-stroke cycle pump having three-stroke cycle pump effect comprises: at least one set of first, second and third pump cylinder-piston assemblies, each pump cylinder-piston assembly incorporating two, horizontally opposed, reciprocating pistons, in a manner to define a central pump chamber, the set of pump cylinder-piston assemblies arranged in triangular configuration and connected with each other so as to operate in synchronization with each other with a phase difference of about 120° therebetween, each pump cylinder having first and second ports adjacent axial ends of the cylinder and a third port adjacent the mid-section of the cylinder; fluid manifold means interconnecting ports of the pump cylinders for flow of fluid therebetween comprising first conduit means connected to each first port of each pump cylinder for passage of fluid in sequence into the central pump chamber of the pump cylinder-piston assembly when the first port of each pump cylinder-piston assembly is open by movement of the opposed pistons therewithin, second conduit means connecting second port of each pump cylinder to the third port of an adjacent pump cylinder-piston assembly when the second port of the first pump cylinder-piston assembly is opened by movement of the opposed pistons therewithin, and to an outlet; valve means disposed in the second conduit means between the third port and the outlet for limiting flow of the fluid to the direction toward the outlet; a set of first, second and third crank or cam means operatively associated with pistons disposed within adjacent axial ends of pairs of the pump cylinder-piston assemblies; and timing means for drivingly connecting the set of crank mechanisms with each other so as to rotate in the same direction in synchronization with each other.

In preferred embodiments of this aspect of the invention, the triangular configuration of the set of pump cylinder-piston assemblies is an equilateral triangle; and the first and second ports of each cylinder are disposed adjacent opposite ends of the pump cylinder-piston assembly for axial flow of fluid therebetween; and the crank mechanisms are housed within crankcases provided for containment of lubricating fluid about moving parts of the engine, preferably all of the pistons disposed in the cylinder-piston assemblies have rear surfaces defining end pump chambers within axial end segments of the cylinders, and the engine further comprises conduit means interconnecting the crankcases for flow of lubricating fluid therebetween, whereby reciprocating movement of the pistons creates a pressure differential between adjacent crankcases that advances sequentially, during revolution, for pumping lubricating fluid between the crankcases.

These and other features and advantages of the invention will be apparent from the following description of a preferred embodiment, and from the claims.

PREFERRED EMBODIMENTS

Figure 1:
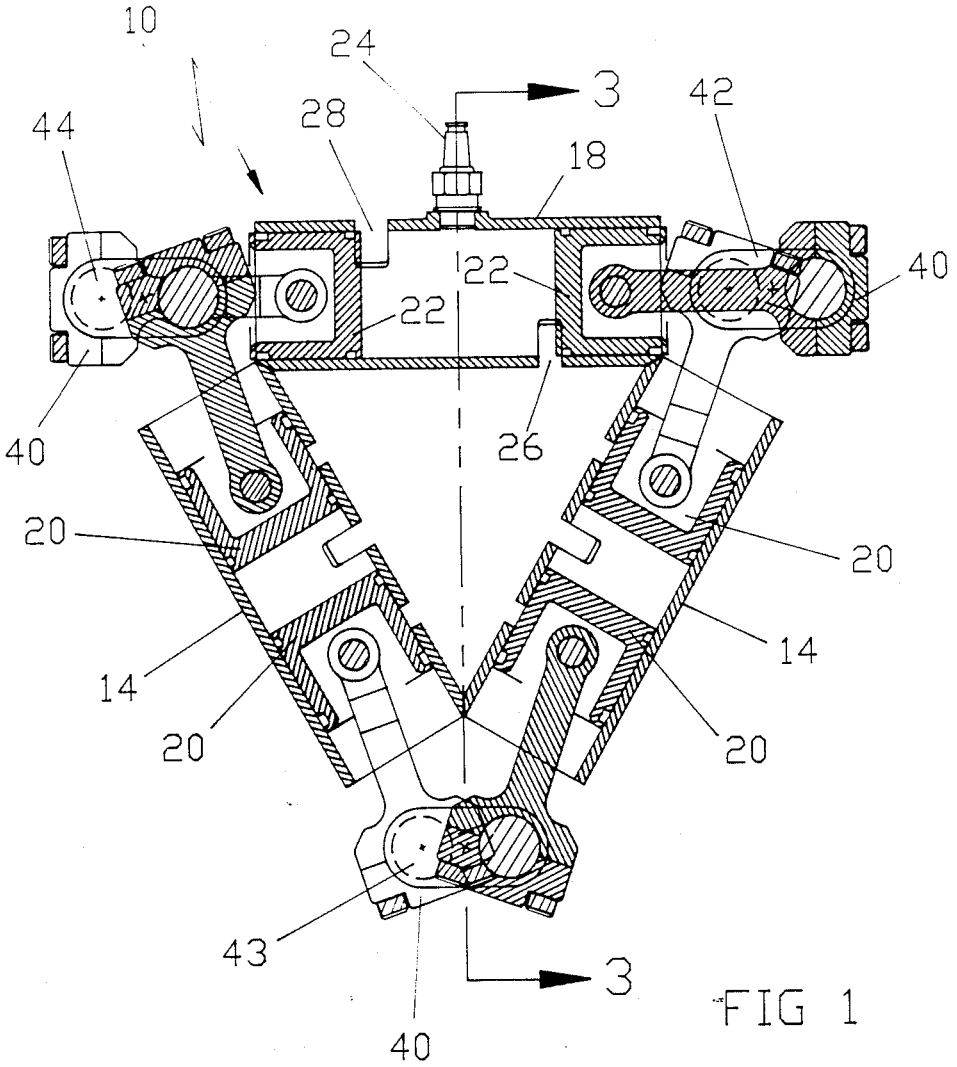
FIG. 1 is a somewhat diagrammatic face plan view of the engine of the invention, sectioned to show a power cylinder-piston assembly and a pair of pump cylinder-piston assemblies.
Figure 19:
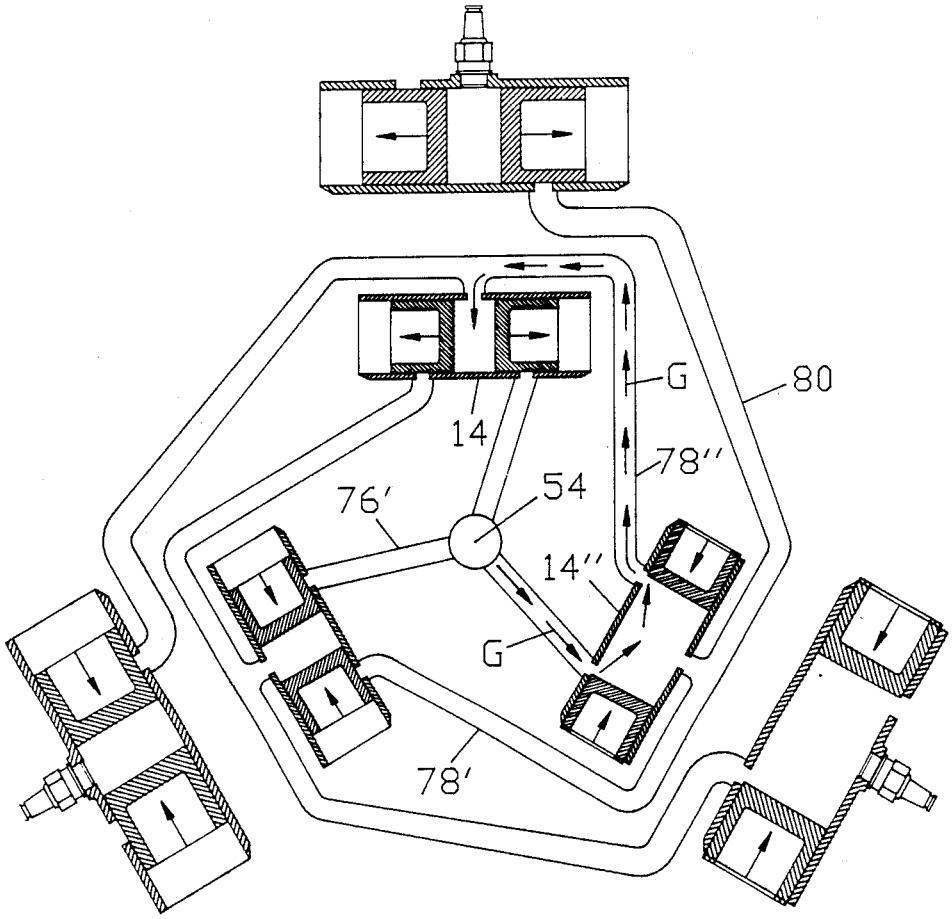
Figure 19A:
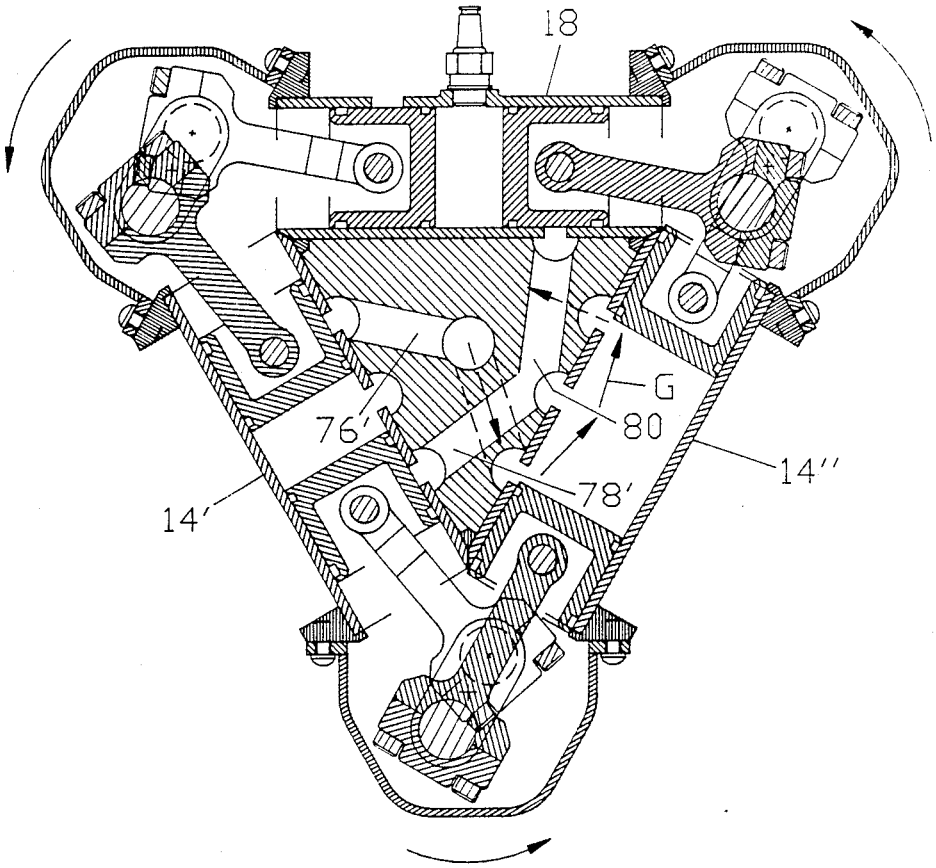
Figure 20:
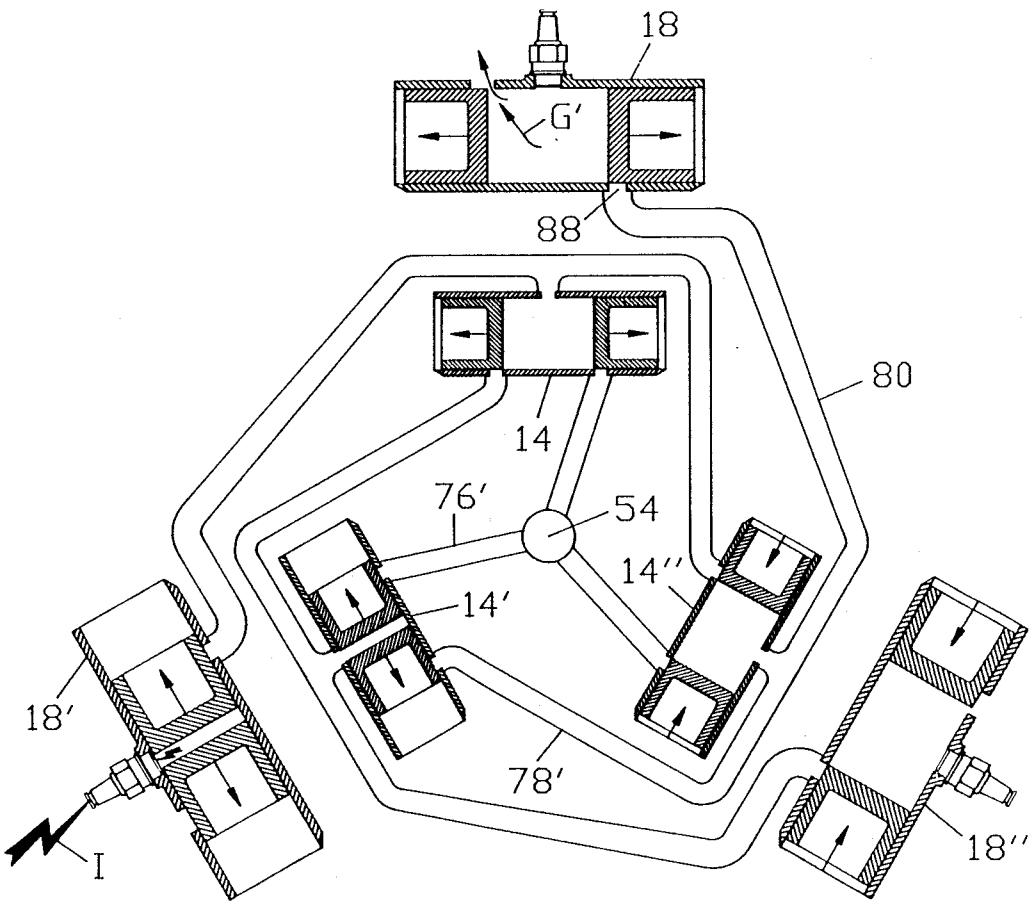
Figure 20A:
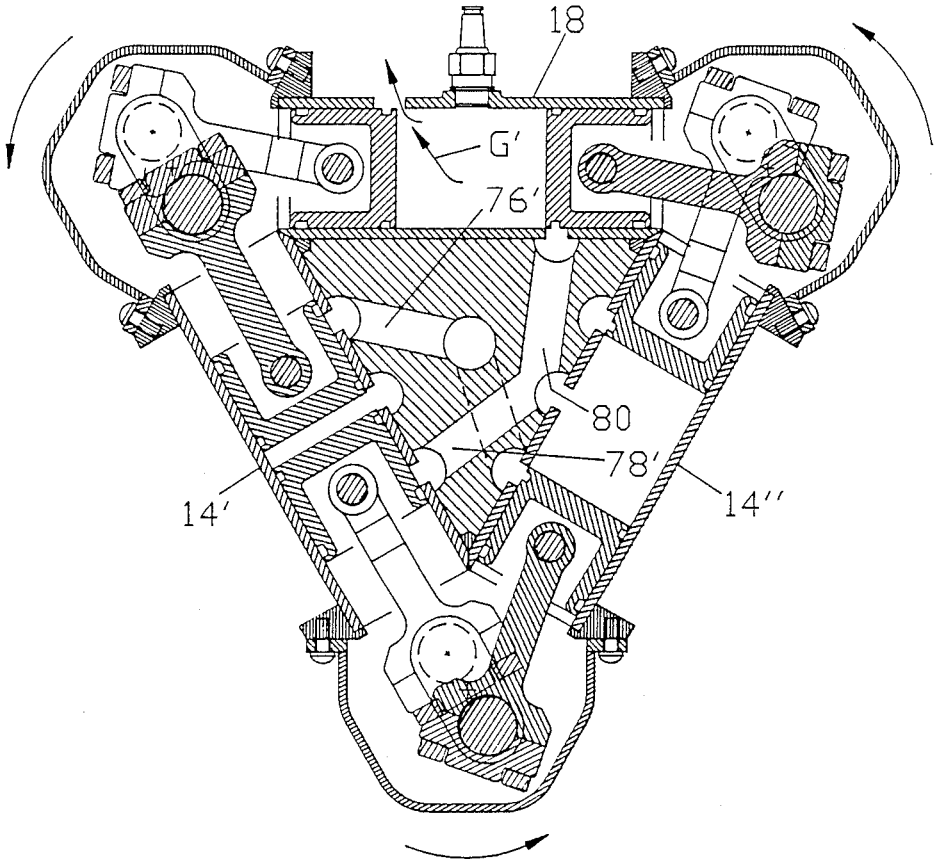
Figure 21:
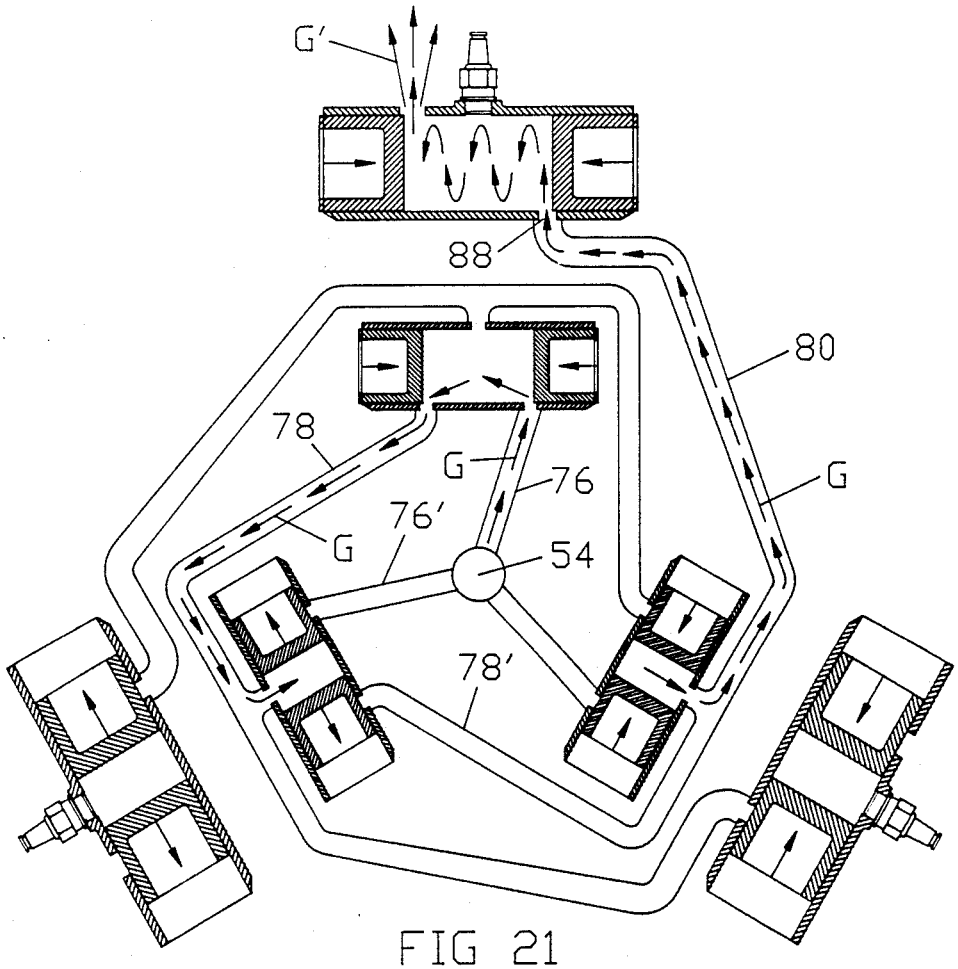
Figure 21A:
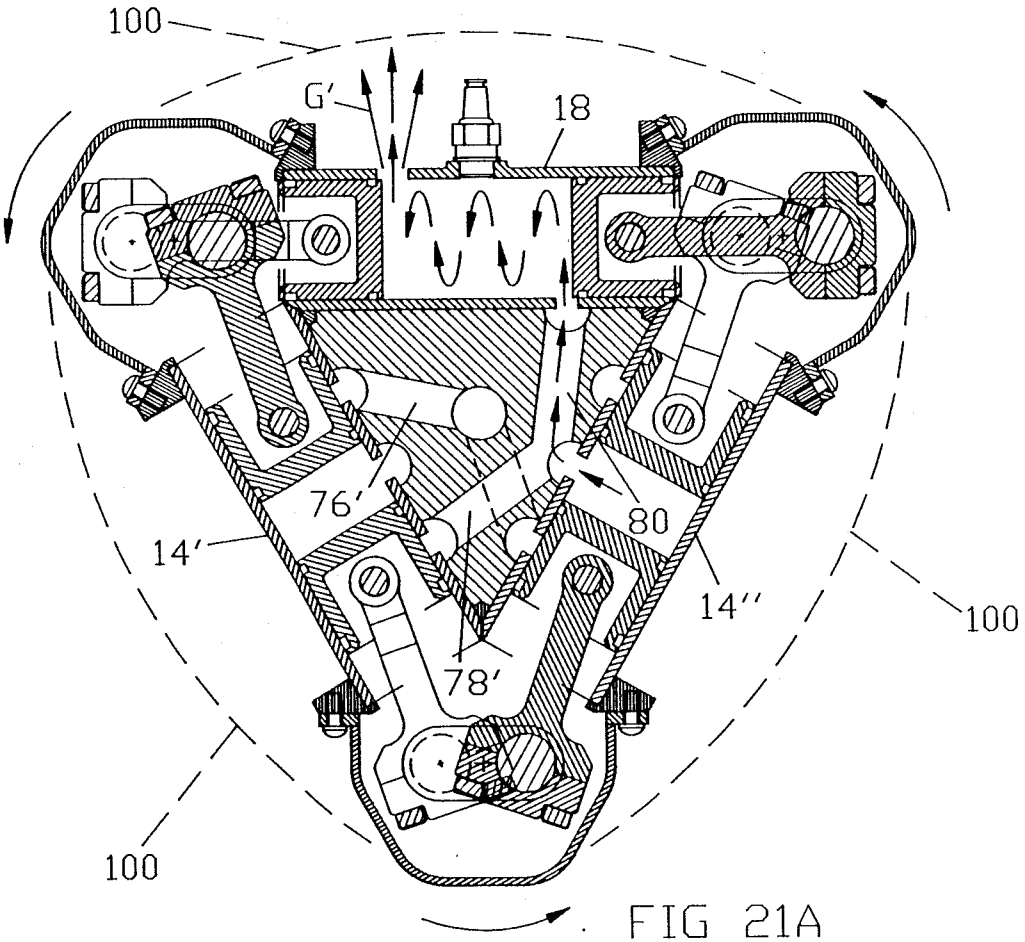
Figure 22:
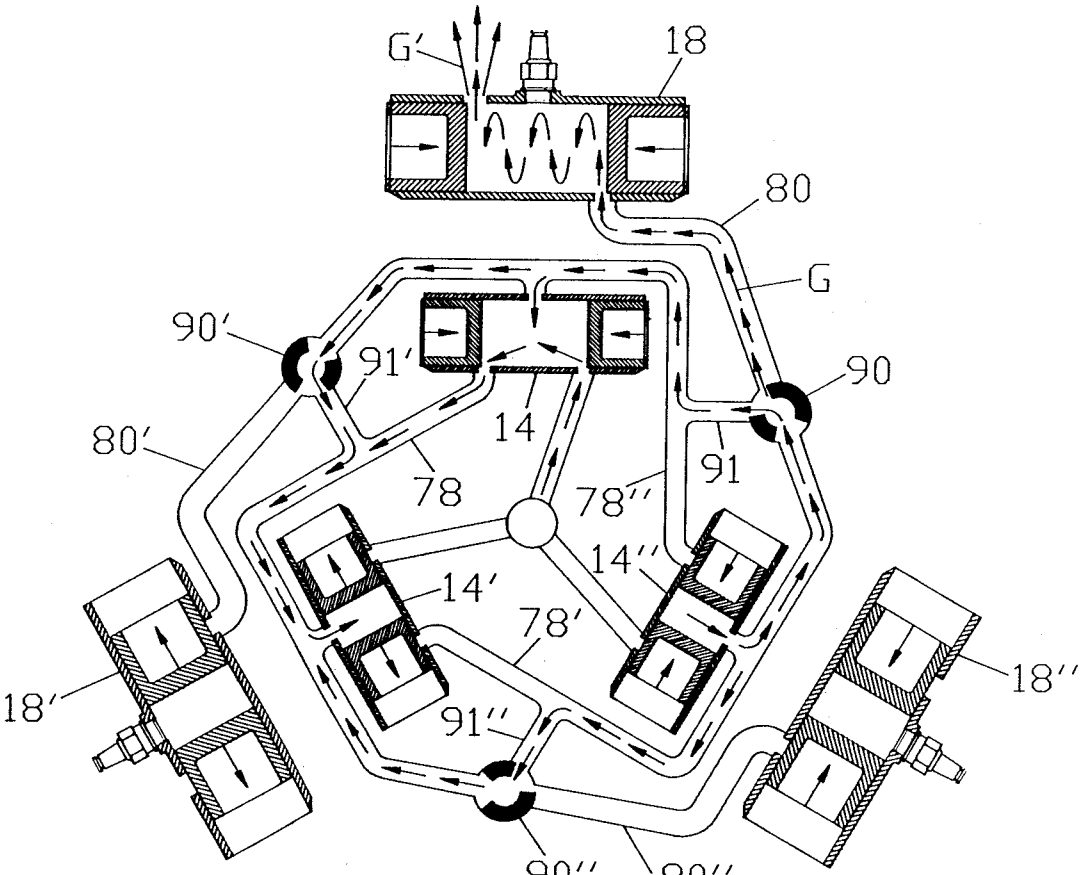

FIGS. 16 through 21 are diagrammatic views of the manifold and cylinder-piston assemblies of the invention representing a sequence of operation at 60° intervals, from 0° (FIG. 16) through 300° (FIG. 21);

FIGS. 16A through 21A are somewhat diagrammatic face plan views of the engine of the invention, sectioned, as in FIG. 1, to show a power cylinder-piston assembly and a pair of pump cylinder-piston assemblies, representing a sequence of operation at 60° intervals, corresponding to FIGS. 16 through 21; and FIG. 22 is a diagrammatic view of the cylinder-piston assemblies and an alternate embodiment of the manifold for reduced power operation.

Figure 2:
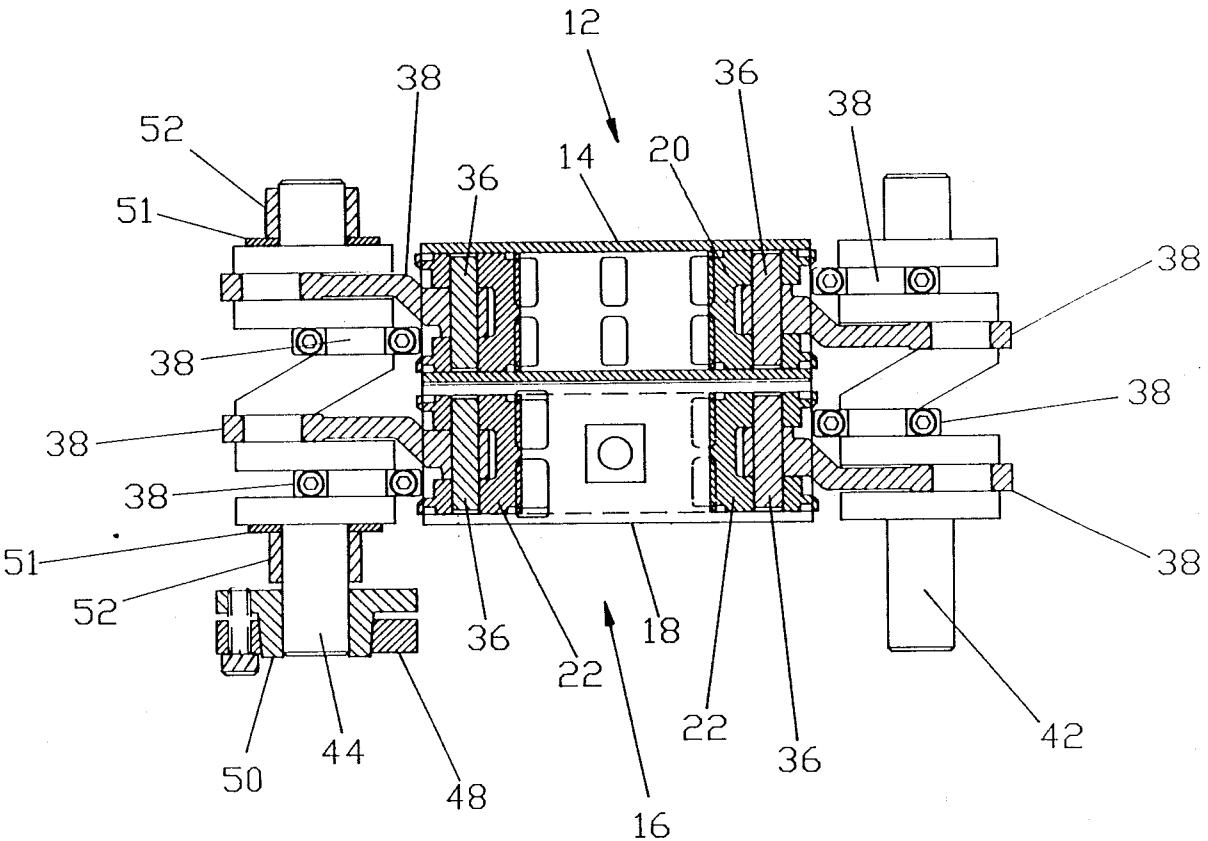
FIG. 2 is a top plan section view of the engine of FIG. 1, including a spur gear assembly.
Figure 3:
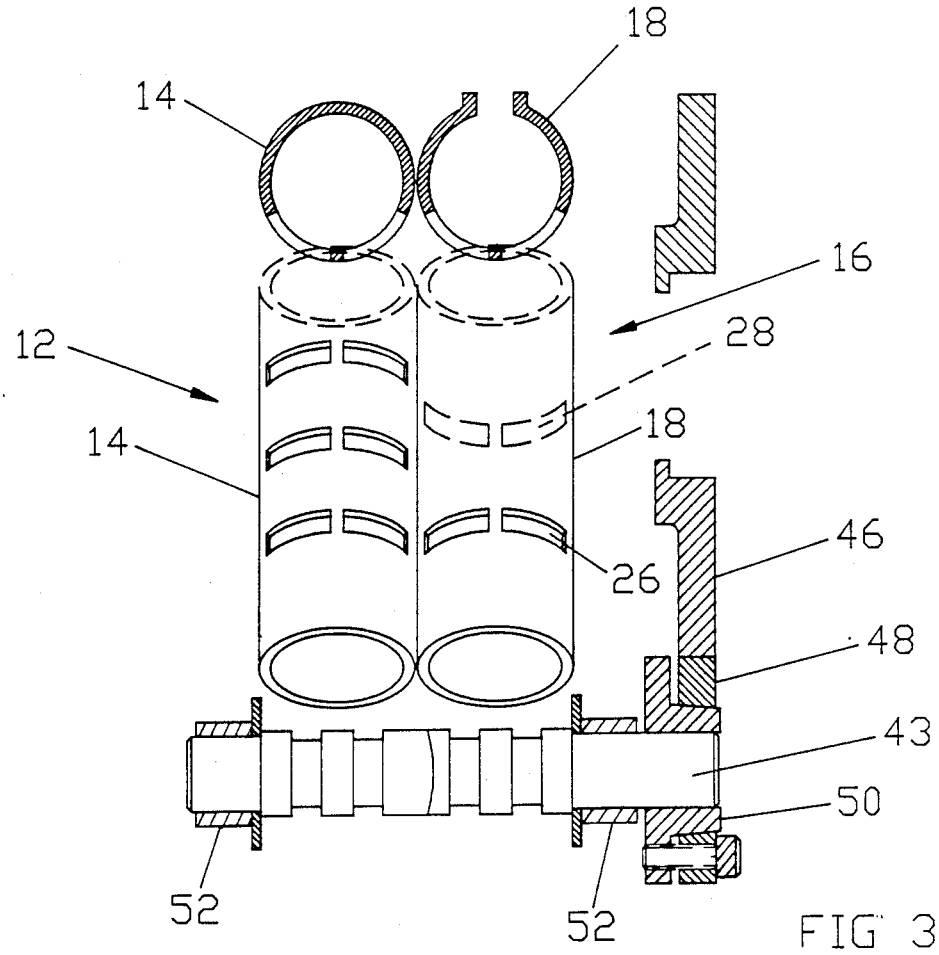
FIG. 3 is a somewhat diagrammatic side section view at the line 3—3 of the engine cylinders of FIG. 1.

Referring to FIGS. 1 through 3, the engine 10 of the invention consists of a bank 12 of three pump cylinders 14 arranged in an equilateral triangle behind a bank 16 of three power cylinders 18. Each pump cylinder and each power cylinder contains a pair of horizontally opposed, reciprocating pistons 20, 22. In each pump cylinder, the pair of pistons defines a central pump chamber, and the bank of pump cylinder-piston assemblies feeds, i.e., scavenges and recharges, the operatively associated bank of power cylinder-piston assemblies. Disposed in each power piston assembly is an ignition means, e.g., a spark plug 24.

The power cylinders each define a recharging or inlet port 26 adjacent one end of the cylinder and an exhaust port 28 adjacent the opposite end of the cylinder. The inlet ports are circumferentially-extending grooves of limited arcuate extent, and fluid is introduced into the cylinders somewhat tangentially, in a manner to generate generally helical scavenging flow for more efficient expulsion of exhaust gases from the cylinders, as will be described below. A gas distribution manifold 30 (FIGS. 6 through 8), also to be described below in more detail, allows intake and recharge pumping without valves or pre-compression.

Figure 4:
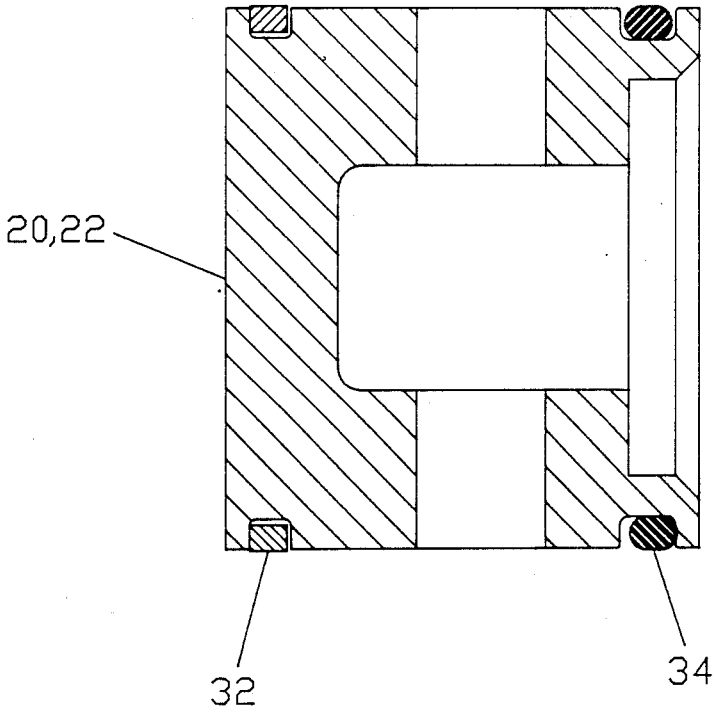
FIG. 4 is a top section view of a piston of the engine of the invention.

Referring to FIG. 4, each of the pistons 20, 22 has at least one top piston sealing ring 32 and preferably has at least one bottom piston ring or o-ring seal 34 to restrict leakage of gas, air or oil around the pistons. Referring to FIG. 2, each piston is connected by a wrist pin bearing joint 36 to an offset connecting rod 38. The offset allows the cylinder-piston assemblies of each bank to lie in a common plane without connecting rod interference.

Figure 5:
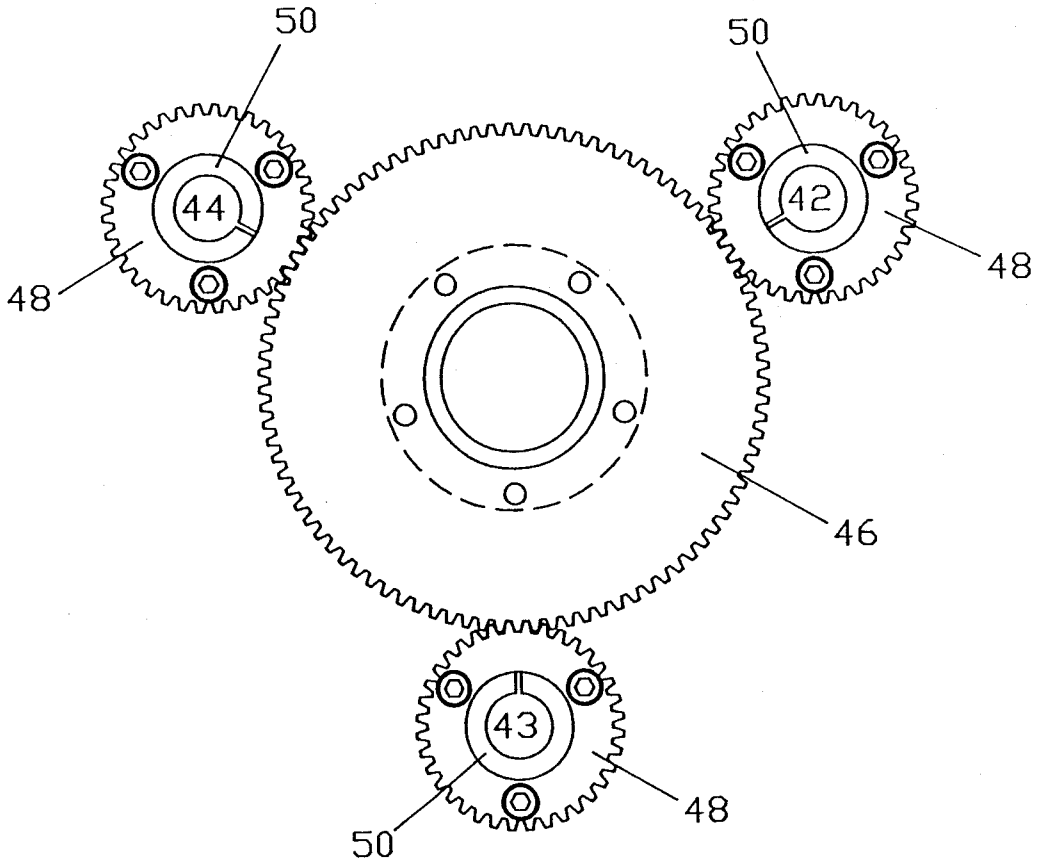
FIG. 5 is a somewhat diagrammatic face plan view of the gear assembly of the engine of FIG. 1.

The connecting rods are joined by journal bearing joints 40 to three identical crankshafts 42, 43, 44 that remain oriented in the same angular relationship with each other throughout each revolution. Crankshaft timing is preferably achieved through a simple gearing arrangement, shown in FIG. 5, of a single, center idler gear 46 mounted on shaft 47 by ball bearing 49, surrounded by spur gears 48, each mounted on a crankshaft by means of a split tapered bushing 50. The crankshafts are supported at each end by a thrust washer bearing 51, and a cage of needle roller bearings 52.

Figure 6:
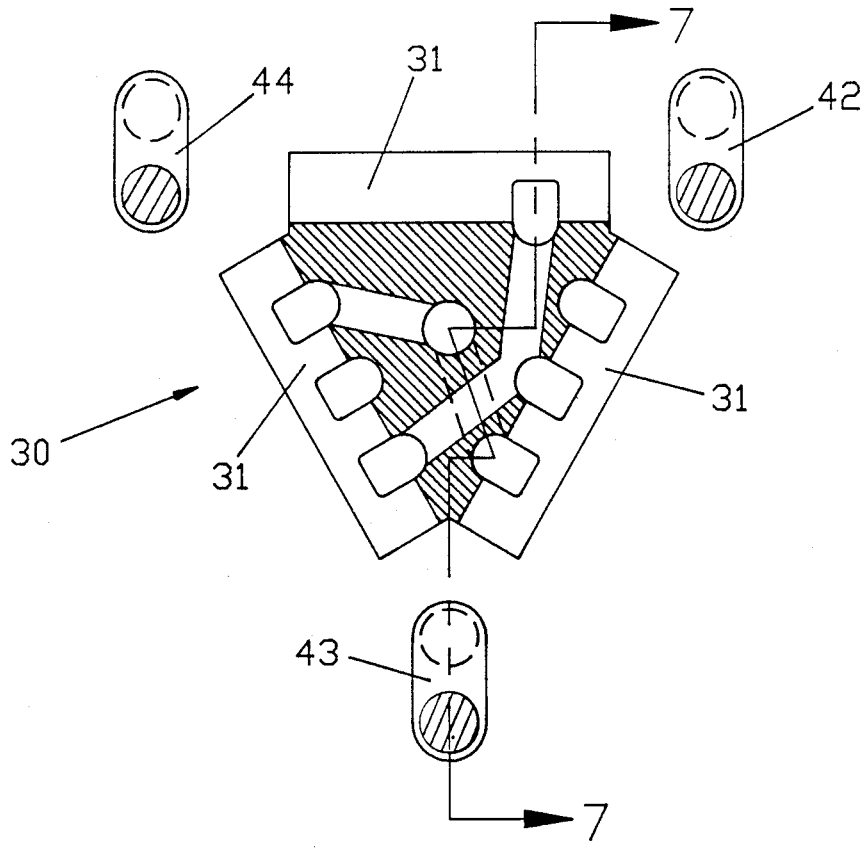
FIG. 6 is a somewhat diagrammatic face plan section view of the engine of the invention showing the gas distribution manifold.
Figure 7:
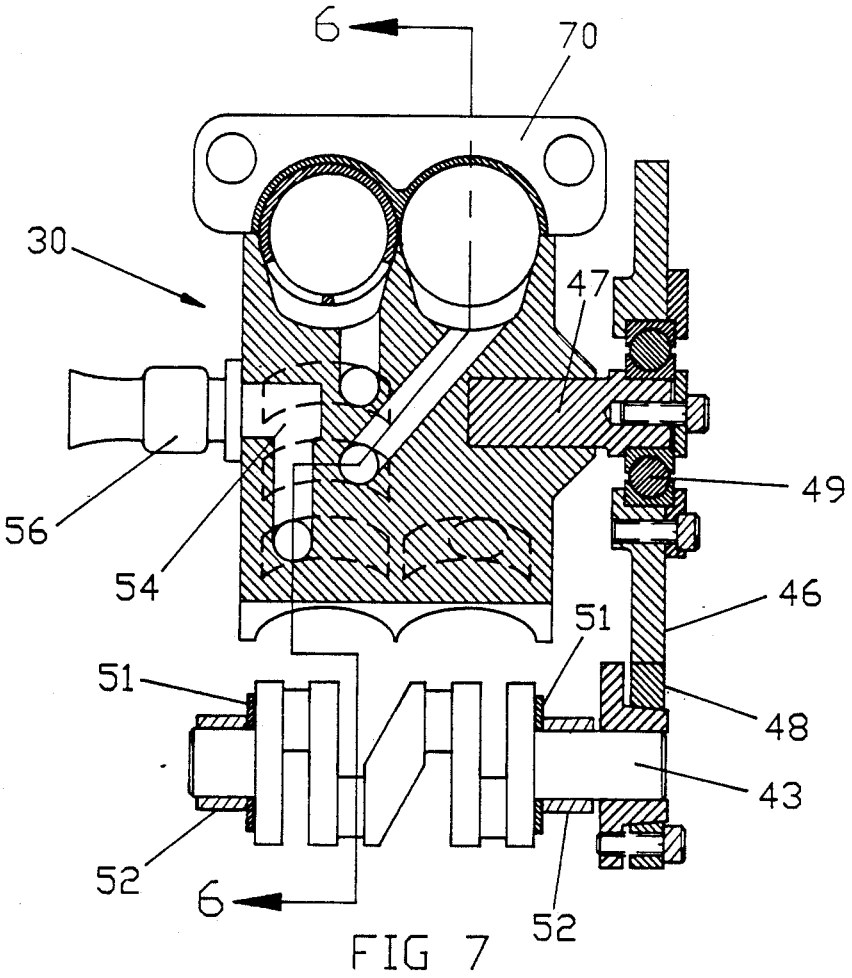
FIG. 7 is a somewhat diagrammatic side section view of the engine at the line 7—7 of FIG. 6.
Figure 8:
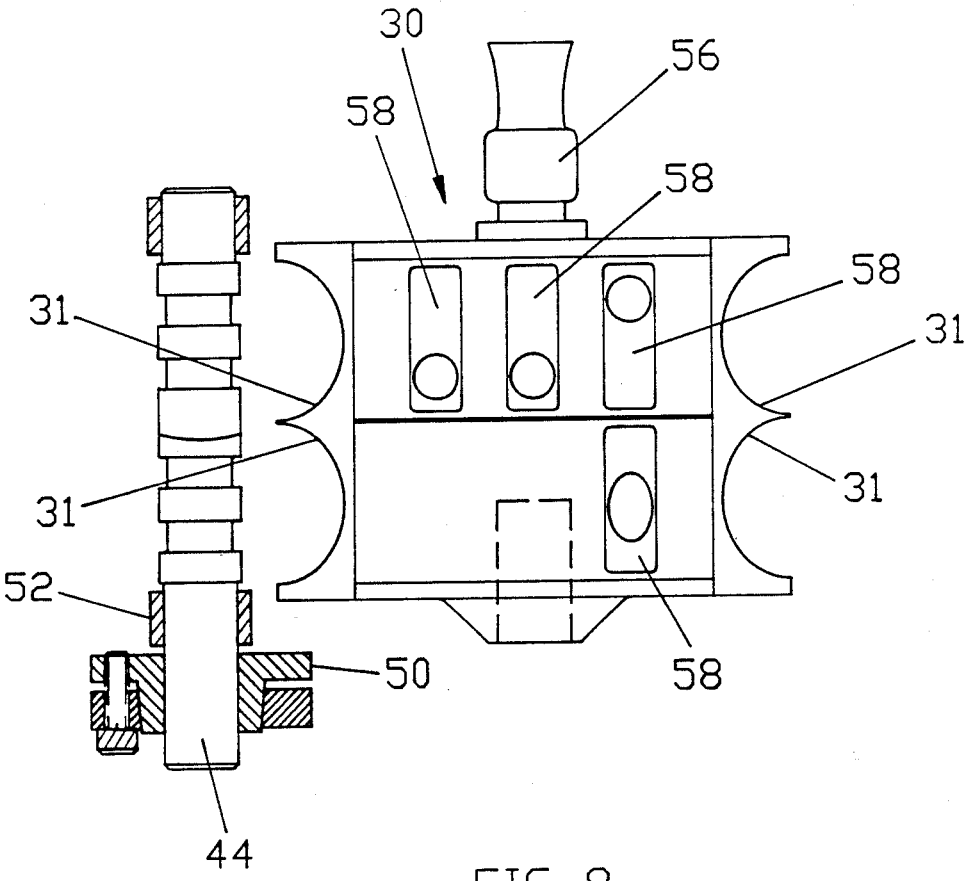
FIG. 8 is a somewhat diagrammatic top plan view of the engine gas manifold.

Referring to FIGS. 6 through 8, the gas distributing manifold 30 is disposed in the center of the coinciding banks 12, 16 of power and pump cylinder-piston assemblies, and has arcuate surfaces 31 that surround approximately 180° of the radially inwardly directed outer surface of each cylinder 14, 18. As an incidental function, the manifold body also supports a stationary idle gear bearing shaft 47. The manifold defines a central gas inlet passage 54, from the rear, leading to a carburetor 56. The circuiting and function of other passages defining conduits interconnecting ports of the pump and power cylinder-piston assemblies will be explained in detail below. The conduits of the manifold terminate at the cylinders in gas grooves, e.g., 58 (FIG. 8), extending about the radially inner surfaces of the cylinder ports to cause full radial flow through the ports.

Figure 9:
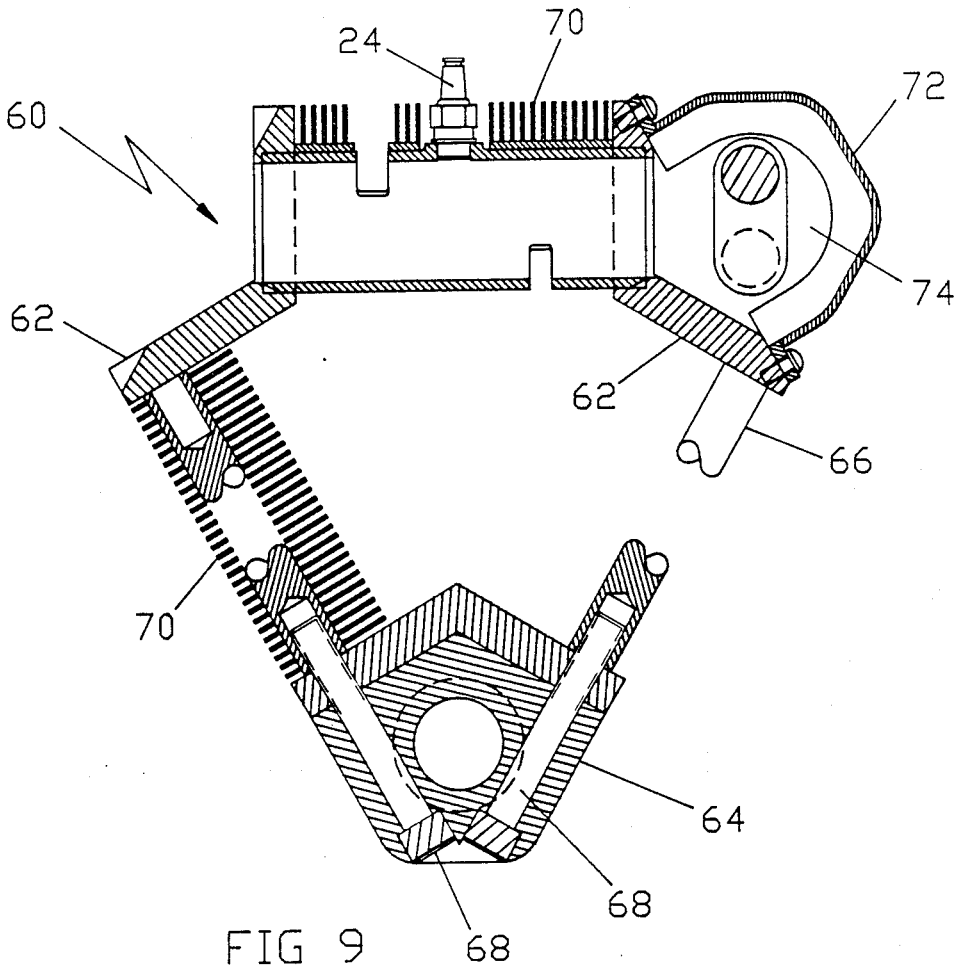
FIG. 9 is a somewhat diagrammatic face plan section view of the cooling fins about the cylinders of the engine of the invention.
Figure 10:
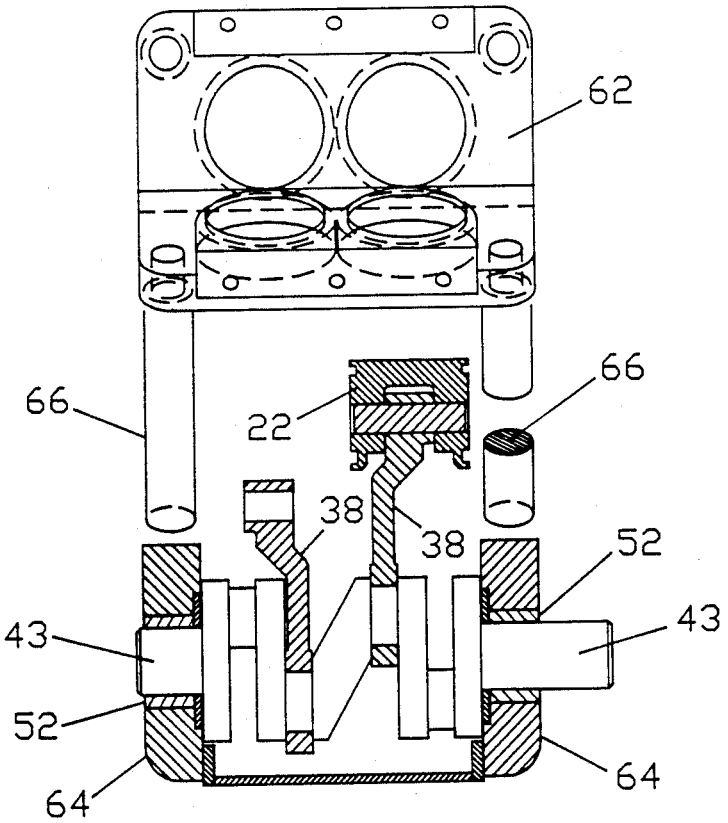
FIG. 10 is a somewhat diagrammatic side section view and FIG. 11 is a somewhat diagrammatic top plan view of the cooling fins of the engine.
Figure 11:
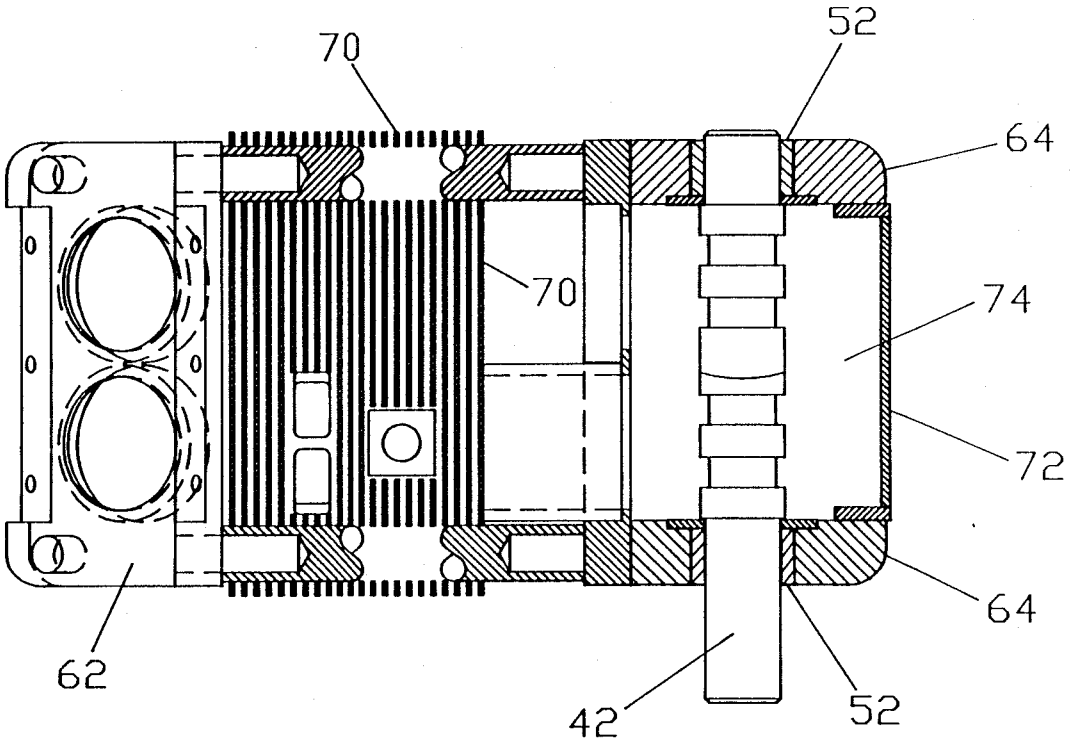

Referring to FIGS. 9 through 11, the cylinders are supported in position by frame work 60, consisting of three cylinder sleeve retainers 62, counter-bored to accept and hold the ends of the cylinders 14, 18. The ends of the crankshafts 42, 43, 44 are received by the needle and thrust bearings 52 (described above), supported by bearing blocks 64. Tierods 66, terminating in cap screws 68, hold the engine components assembled, and, further, absorb tension and compression stresses to reduce or eliminate axial stressed exerted on the cylinder sleeves.

Cooling means consisting of fins 70 surround the radially outwardly directed surface of each cylinder, with clearance openings provided for the spark plugs and exhaust ports. Sheet metal covers 72 surround the open area between sets of bearing blocks, forming crankcases 74, and contain lubricating oil which is splashed about by action of the moving crankshafts, connecting rods and pistons.

Figure 12:
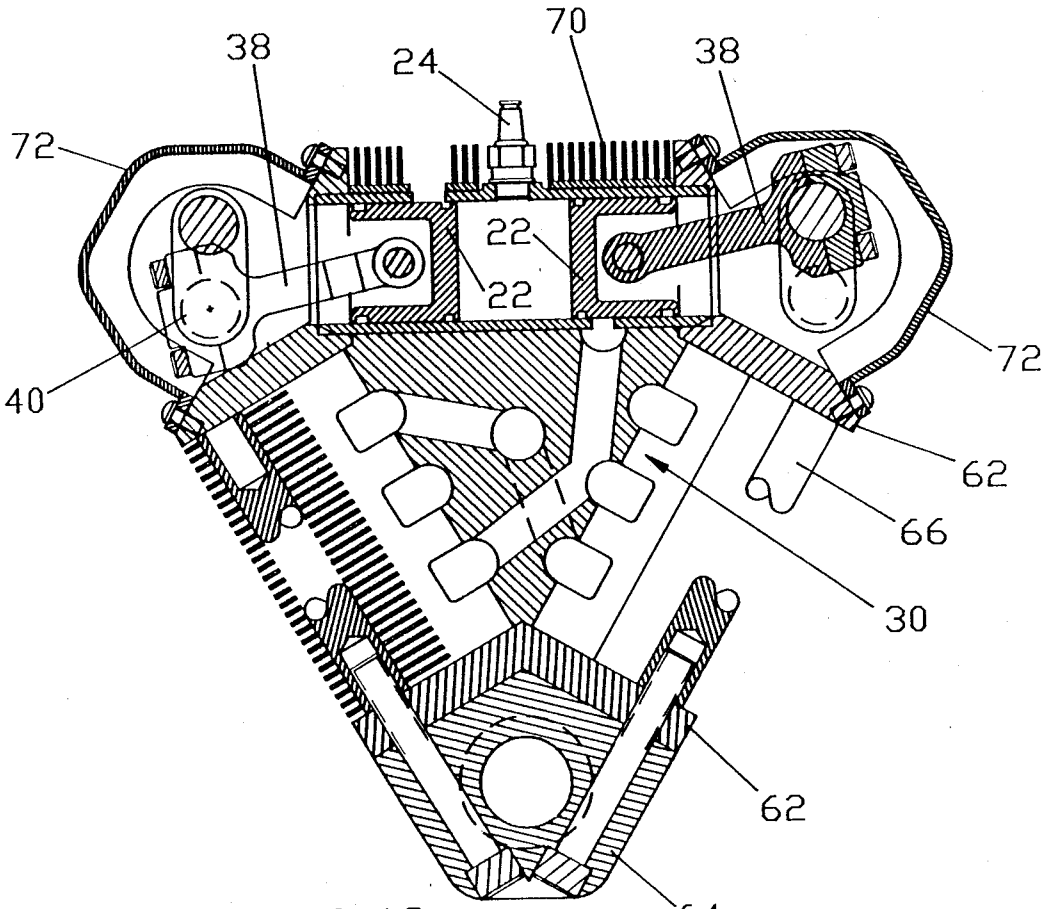
FIGS. 12, 13 and 14 are somewhat diagrammatic face plan, side, and top plan views, respectively, taken in section, of the engine assembly of the invention.
Figure 13:
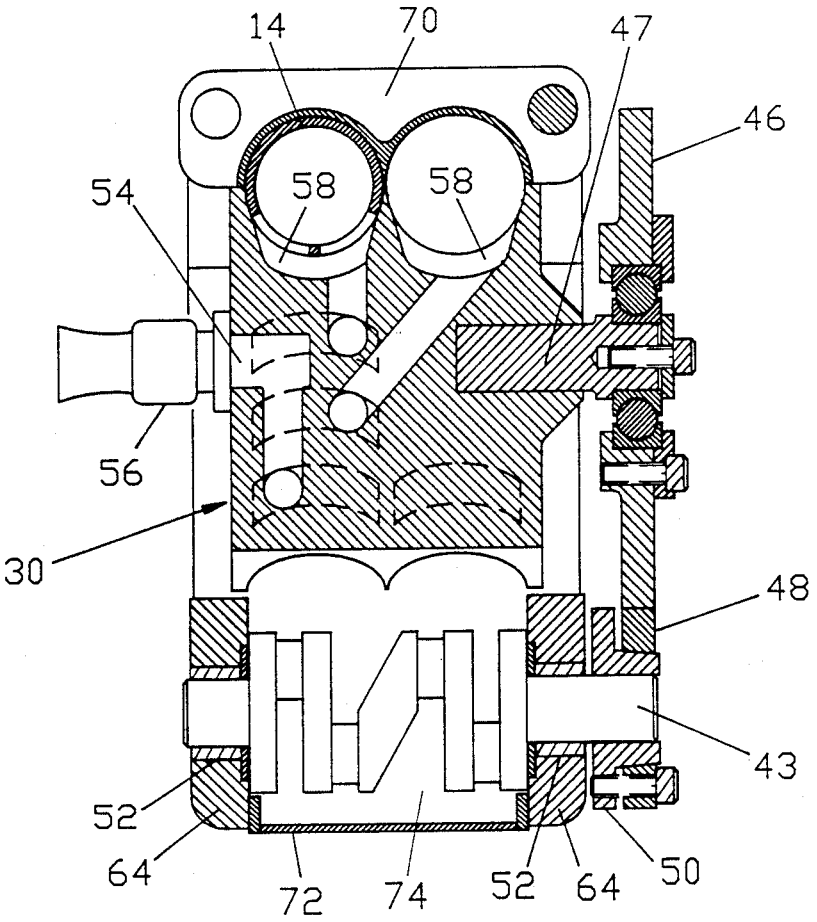
Figure 14:
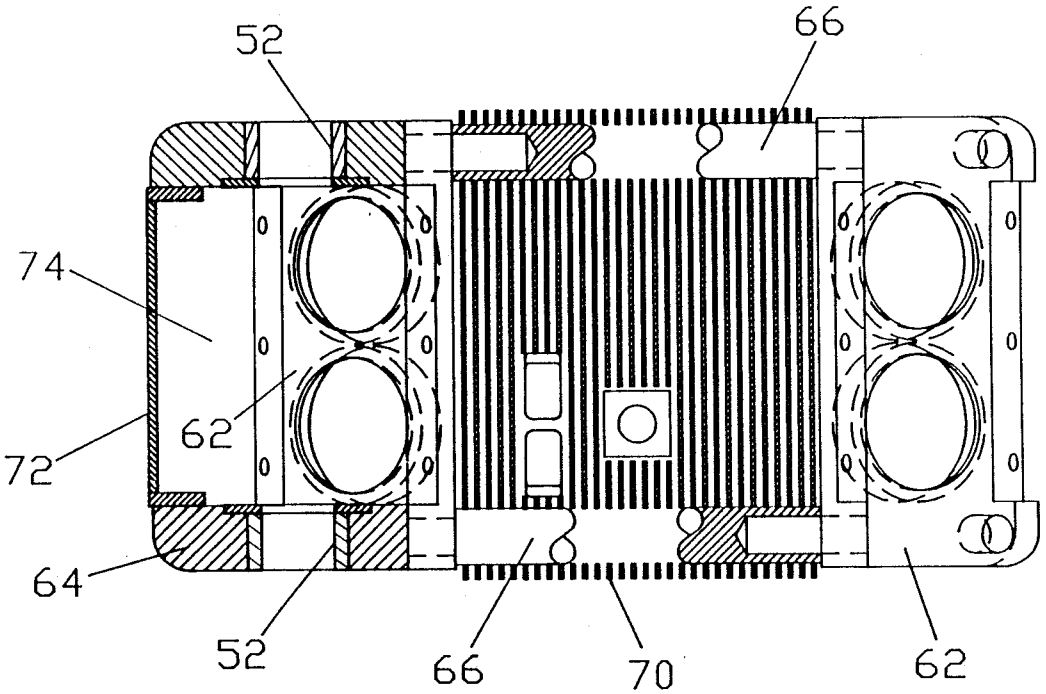

Engine assemblies are shown in more detail in FIGS. 12 through 14.

Referring now to FIGS. 15 through 21, the gas conducting conduits of the manifold 30 (shown also in FIGS. 15A through 15C) are shown diagrammatically. For clarity, and to avoid a crossing of conduits in these figures, the center ports of the pump cylinders are shown in the radially outwardly directed wall. In actual engine construction, all three of the pump cylinder ports are defined in the radially inwardly directed wall of the pump cylinders.

Figure 15:
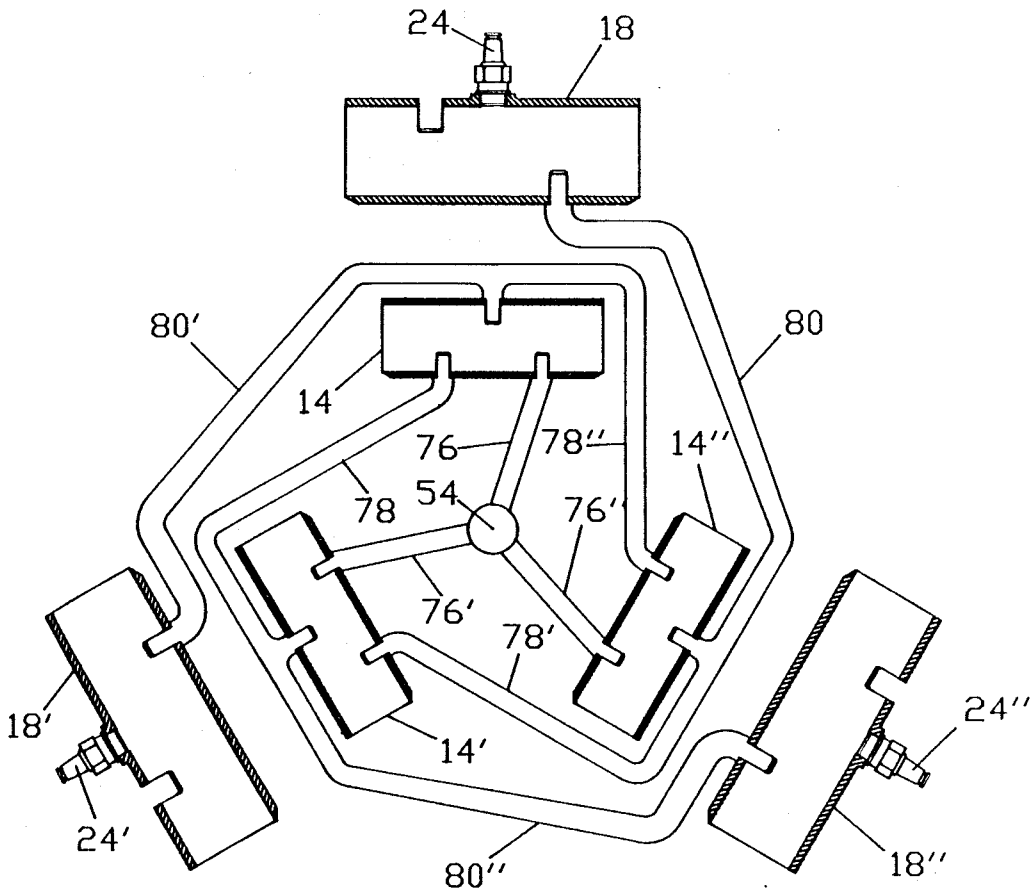
FIG. 15 is a diagrammatic view of the manifold and cylinder-piston assemblies of the invention.
Figure 15A:
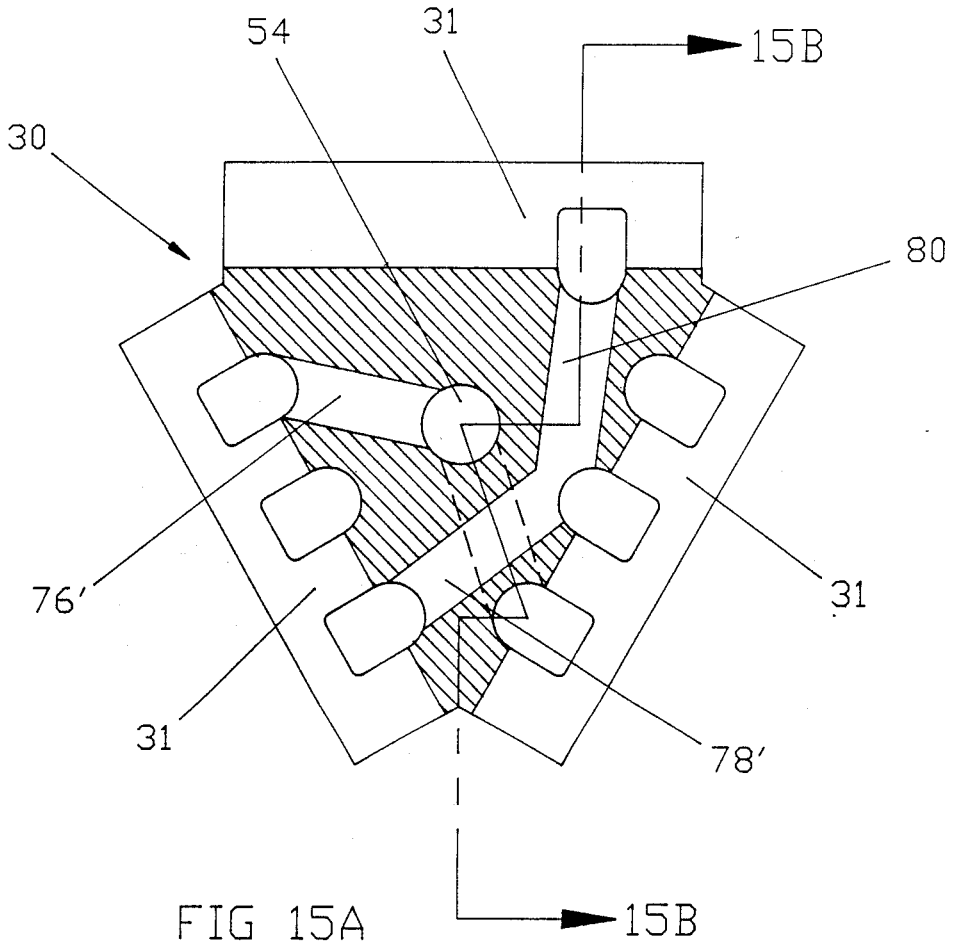
FIGS. 15A, 15B and 15C are, respectively, face plan section (at line 15A—15A of FIG. 15B), side section (at line 15B—15B of FIG. 15A) and top plan views of the gas manifold shown diagrammatically in FIG. 15.
Figure 15B:
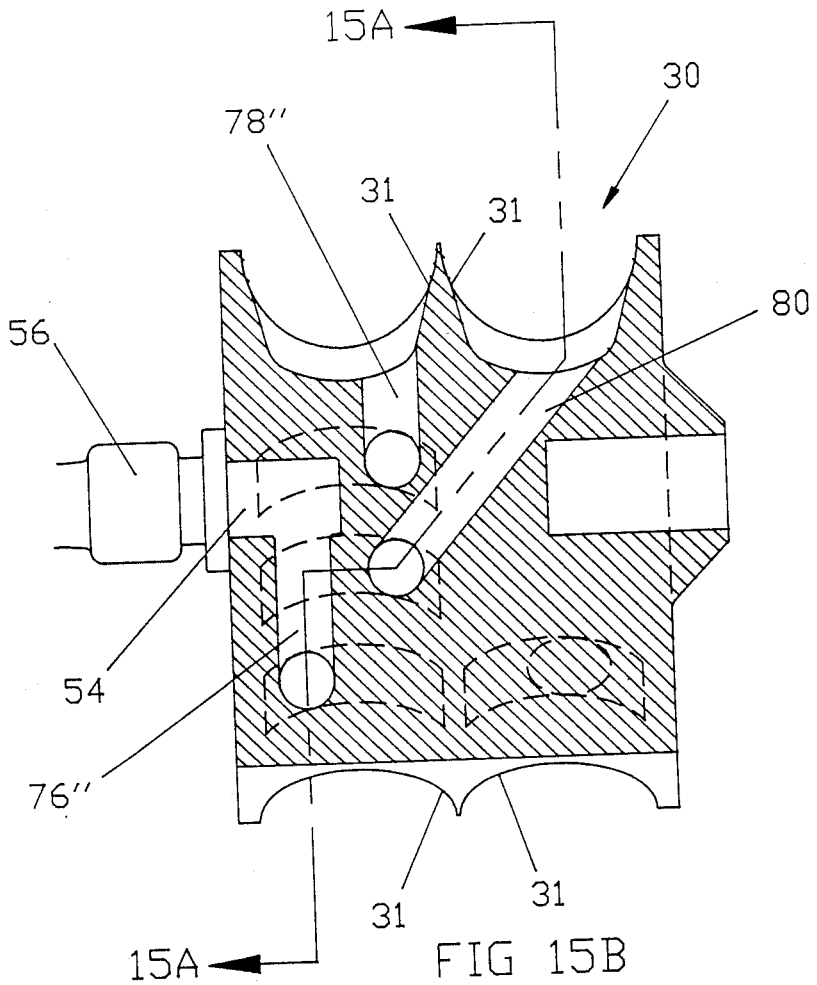
Figure 15C:
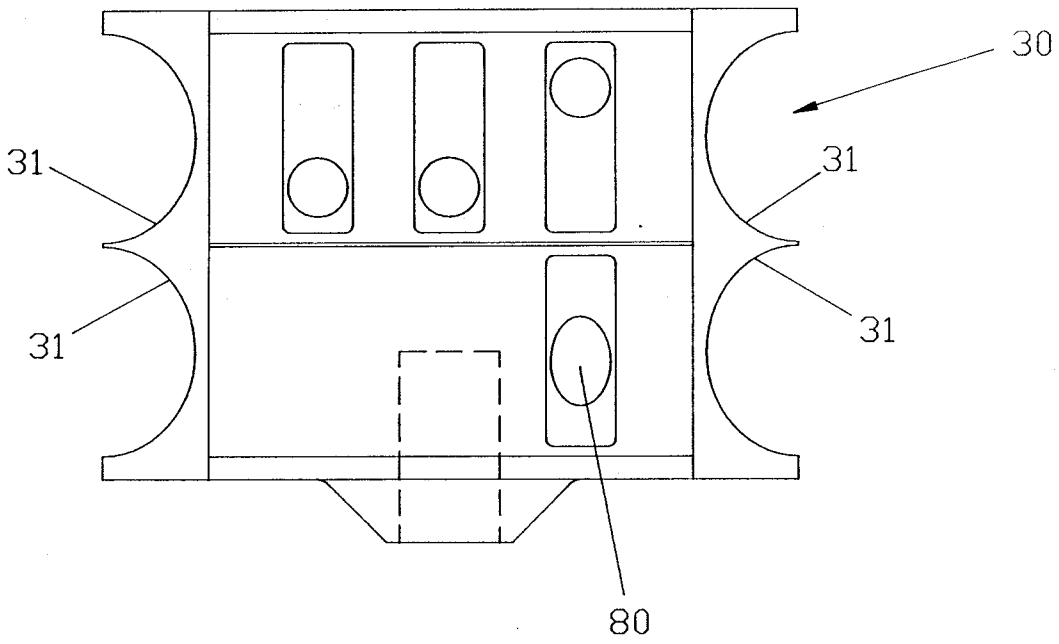

Referring to FIG. 15, the manifold has three symmetrically identical sides and three identical conduits of each type: main intakes 76, cross intakes 78 and recharges 80, as well as the central passage 54 to carburetor 56, ten passages in total. The interconnecting passages are advantageously as short as possible.

Referring now to FIG. the manifold and cylinder-piston assemblies are shown with the pistons in place. (Again, for clarity, seal grooves and wrist pin holes are omitted, and the pump cylinder-piston assemblies 14 are shown at a reduced scale to illustrate that they are positioned behind the power cylinder-piston assemblies 18.) In FIG. 16A, the actual engine 10 is represented with the pistons in corresponding position; only the first power cylinder-piston assembly 18 and the second and third pump cylinder-piston assemblies 14', 14'' are shown in this figure (and subsequent FIGS. 17A through 22A), and, for clarity, the discussion will be confined primarily to these cylinder-piston assemblies. Cooling fins 70 are also omitted from subsequent figures. Rotational direction of the crankshafts is indicated by arrows, R and is the same for all three crankshafts.

For simplicity of design and symmetrical balance, corresponding pairs of pump/power cylinder-piston assemblies (14/18; 14'/18'; 14''/18'') coincide, without phase difference, and exhaust gas scavenging and recharging, e.g., of the first power cylinder-piston assembly 18, is performed by an adjacent pump cylinder-piston assembly, e.g., pump cylinder-piston assembly 14''. For balance and simplicity of design of the engine of the invention, a phase difference of about 120° between adjacent cylinder piston assemblies in each bank is preferred.

Figure 16:
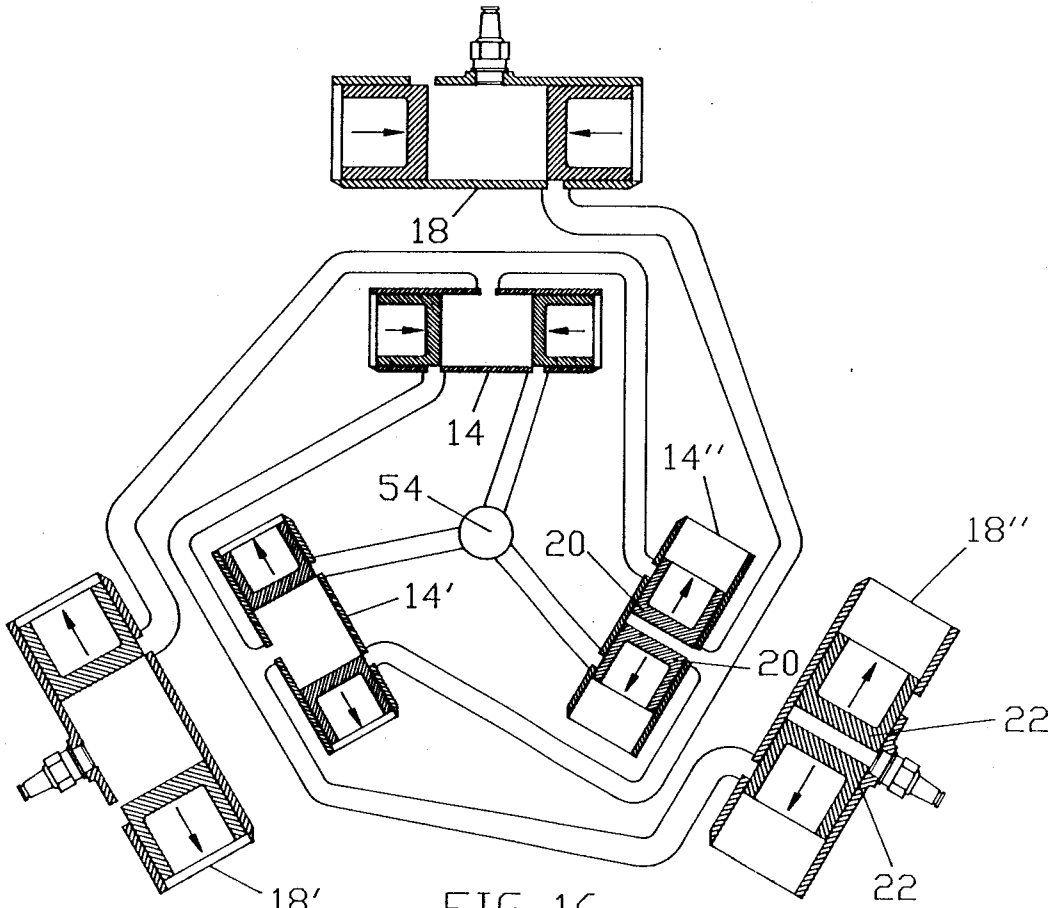
Figure 16A:
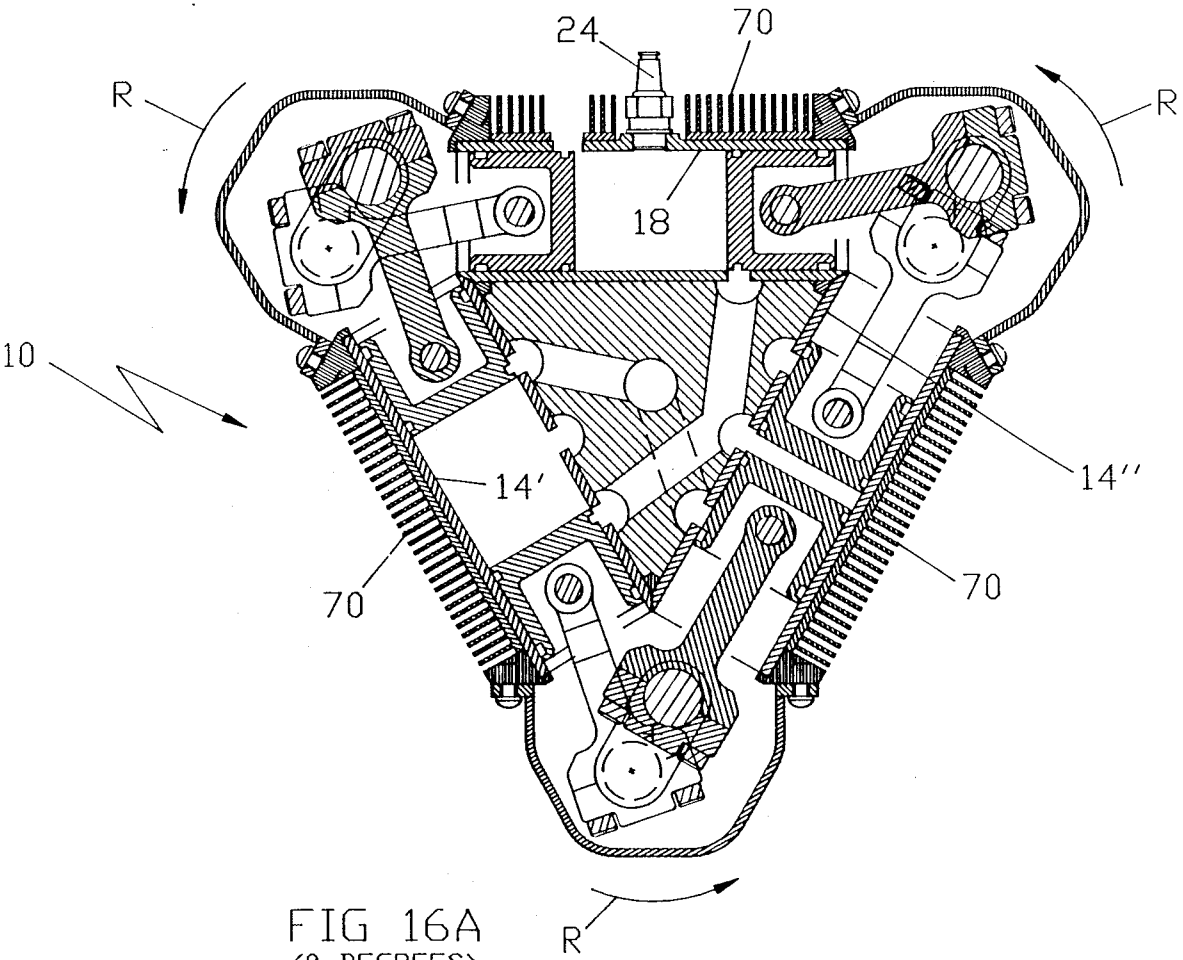

In FIG. 16, the opposed piston pairs of the third pump cylinder-piston assembly 14'' and of the third power cylinder-piston assembly 18'' are at "top dead center" position or "zero degrees" of crankshaft position. Arrows on the pistons show the direction the pistons 20, 22 will travel during the next increment, between FIG. 16 and FIG. 17. In the subsequent figures, the gas (indicated by arrows, G) is caused to flow from the central passage 54 through the main inlet passage 76' and port 82 of pump cylinder-piston assembly 14' and (by displacement) through cylinder 14' through port 84, through the cross intake passage 78' to port 86 of pump-cylinder-piston assembly 14'' and finally through recharge passage 80 to inlet port 88 of power cylinder 18.

Figure 17:
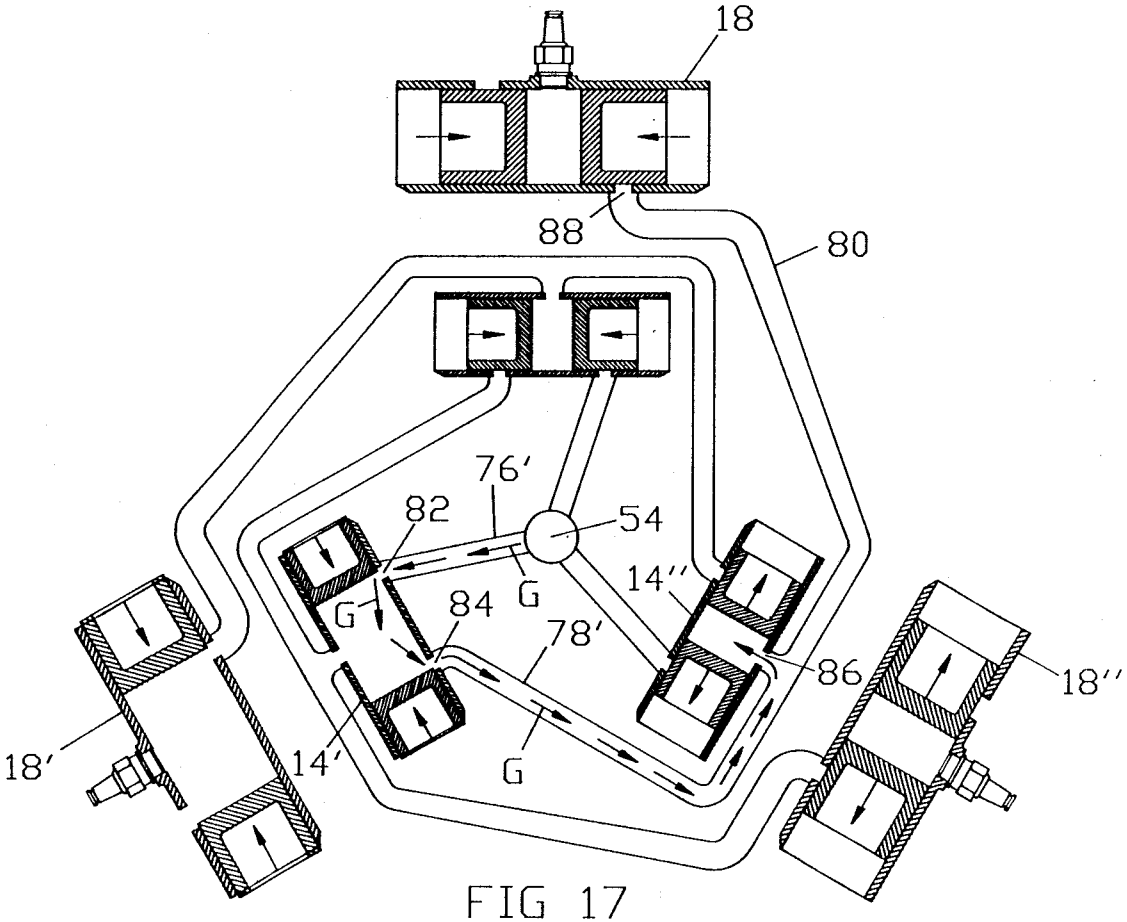
Figure 17A:
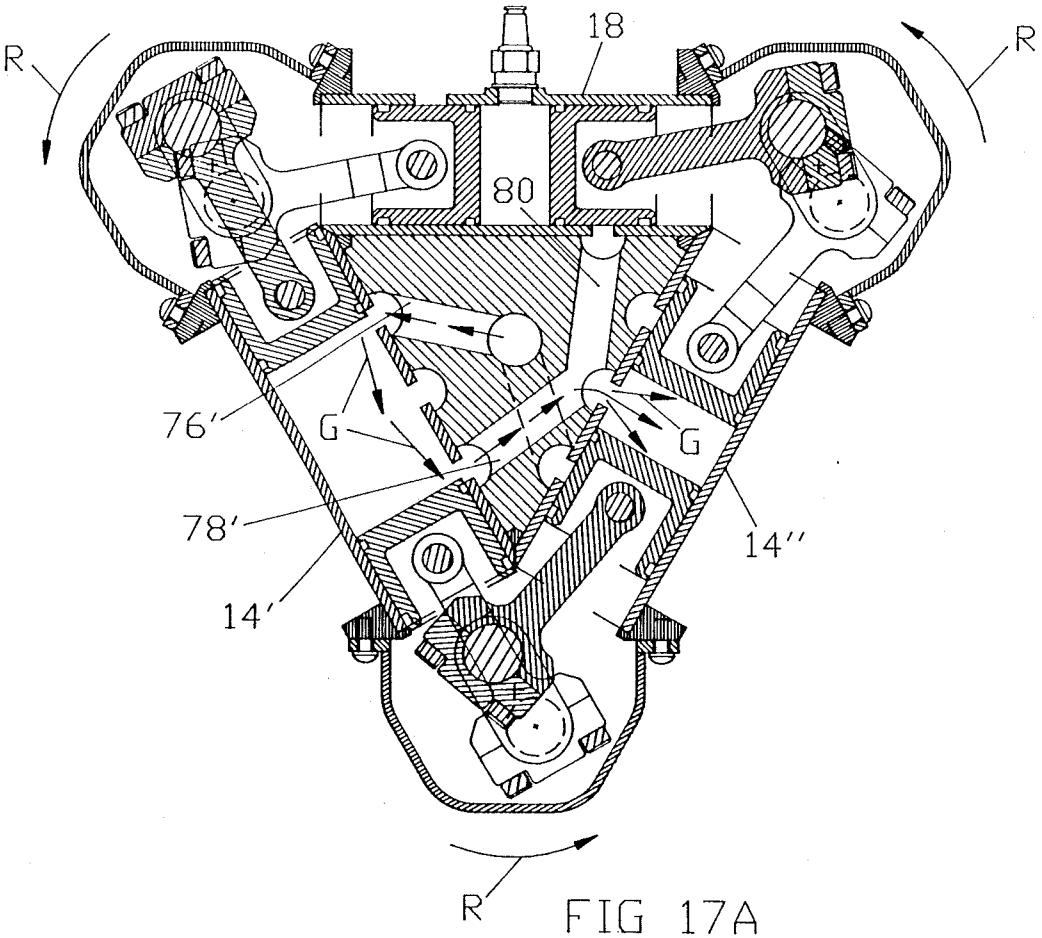

Each cylinder and its pair of pistons operates on three distinct strokes, each of approximately 120° duration. FIG. 17 shows the cranks in a position 60° later than FIG. 16, or halfway through the first stroke. Pump cylinder-piston assembly 14' is assumed to be full of gas from the last cycle and the gas (arrows G) flows (by displacement) through this cylinder and into pump cylinder-piston assembly 14''. Power cylinder-piston assembly 18 is, at this point, about halfway through its compression stroke.

It should be noted that during each 120 stroke, only the pair of end ports in a single pump cylinder-piston assembly and a single power cylinder-piston assembly are open, both on the same side of the triangle. All other cylinder end ports are blocked and sealed by the pistons therewithin.

Figure 18:
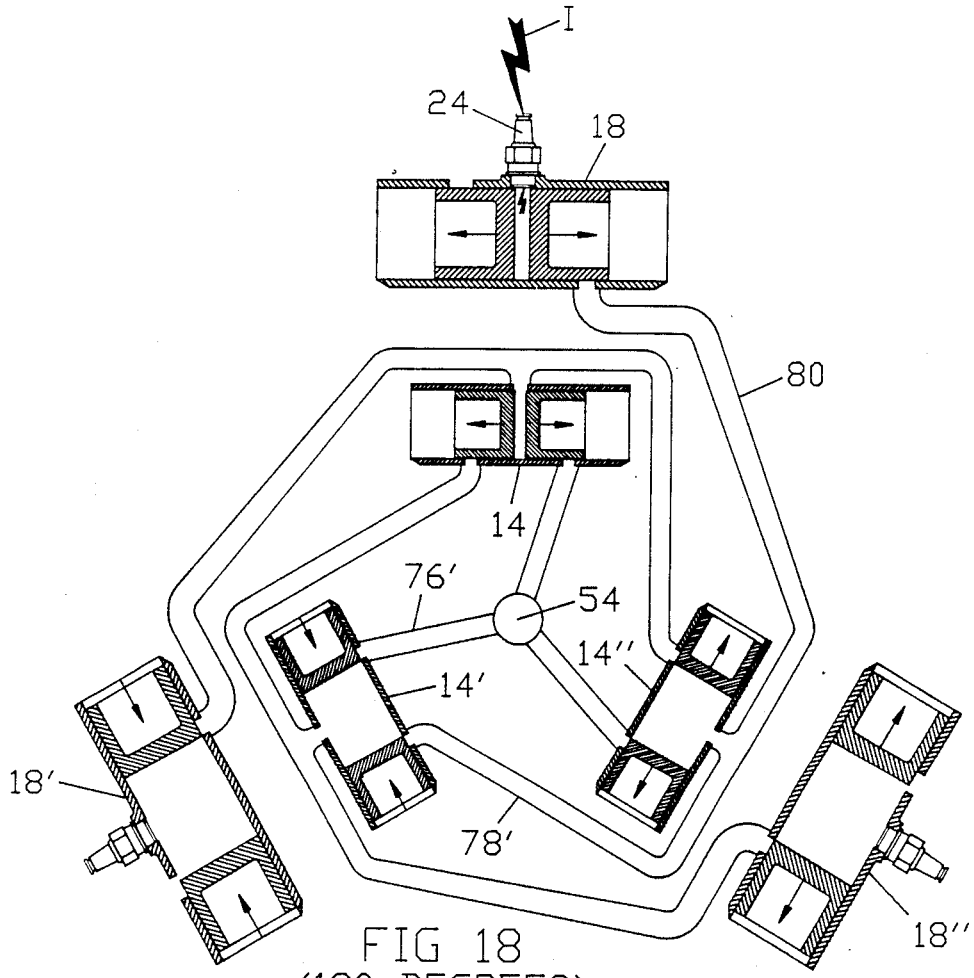
Figure 18A:
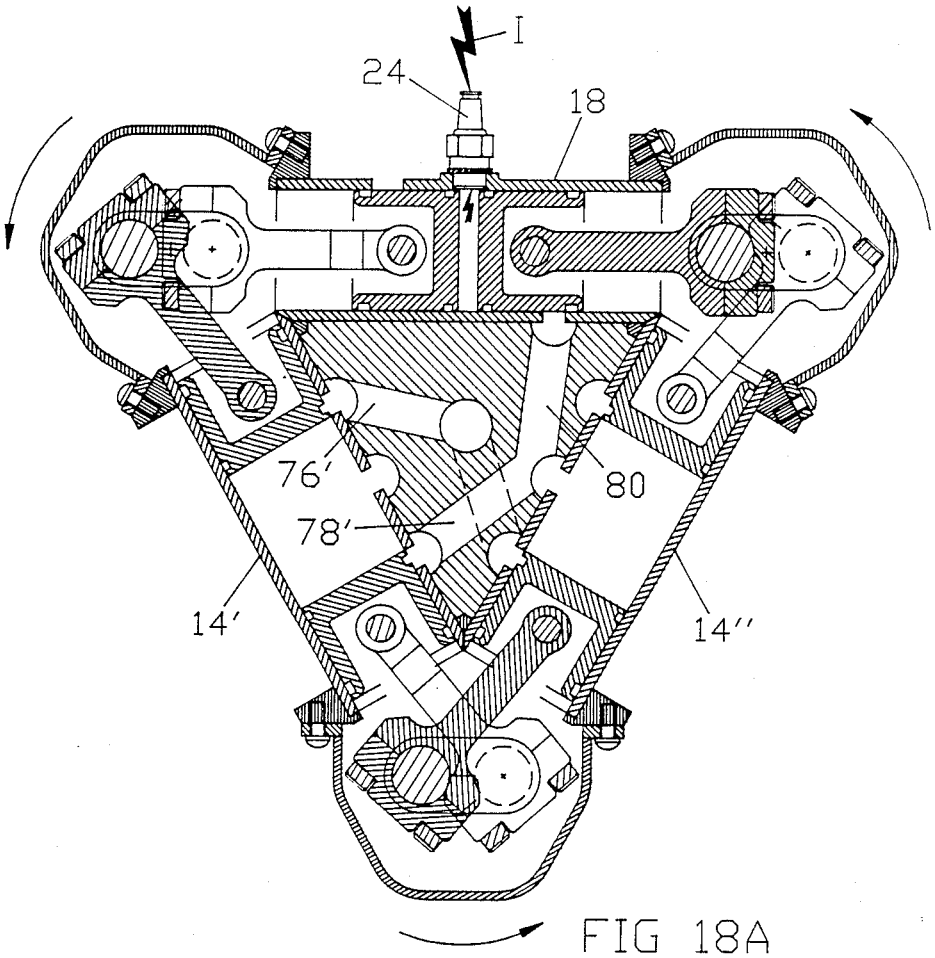

In FIG. 18, the engine is at the end of the first stroke, with power cylinder-piston assembly 18 at the top dead center firing Position (ignoring spark advance), ignition being indicated by "I".

FIG. 19 shows the engine halfway through the second stroke, with power cylinder-piston assembly 18 in a power stroke, pump cylinder-piston assembly 14 in the initial intake stroke, and pump cylinder-piston assembly 14'' cross-venting pump cylinder-piston assembly 14 to the carburetor.

In FIG. 20, the engine is at the end of the second stroke, with power cylinder-piston assembly 18 blowing down the pressure of the spent burned gases (G') just before opening of the recharge port 88.

FIG. 21 shows the engine halfway through the third stroke, with power cylinder-piston assembly 18 being recharged by pump cylinder-piston assembly 14''. The entry of the charge gas is tangent to the cylinder walls, due to the angle of the recharge passage in the manifold, thus resulting in helical flow along the cylinder axis, driving most of the exhaust gases out the exhaust ports.

The end position of the third (and last) stroke is again FIG. 16, and the cycle repeats.

Obviously, this three stroke cycle occurs simultaneously between the sets of cylinders around the engine, sequentially, once during each revolution. Since the actual intake or filling of each pump cylinder occurs over a period of 240°, very high speed operation and high power output are achievable.

For most small engine applications, adequate speed and power regulation may be achieved, in a fuel-ignition or glow plug engine of the type described, by conventional carburetor throttling. However, under low speed operation, a partial vacuum will exist in the pump cylinder during, and for a period after, the opening of the recharging ports in the power cylinder. The embodiment of FIG. 22 prevents generation of vacuum (which could draw in exhaust gases to mix) by ensuring that the inlet side of the pump and the carburetor are always at wide open (unthrottled) position so that no vacuum, other than that required to sustain gas flow, exist in the pump cylinder. Regulation of power is achieved by means of one or more flow control valves 90 used to divert or short circuit a variable portion of the output of the pump cylinder back to any convenient passage on the inlet side, e.g., via short circuit conduits 91. Little power is wasted, since practically no compression of the fuel gas mixture takes place. While three are shown, one is sufficient for the desired result.

Alternate Embodiments

Other embodiments are within the following claims. For example, the engine of the invention may be operated on the gasoline Otto cycle, as described, with other fuels, or with glow plug ignition. The engine may also be operated on the diesel cycle, and it may be equipped with multiple carburetors, or fuel injection.

Timing or the crankshafts may also be accomplished by means of chain drives, timing belts, cable chain drives or the like. Timing might also be achieved by means of a chain drive running inside the engine, between pump and power cylinder banks, lubricated by crankcase engine oil.

Also, a volume differential is created sequentially between each pair of crankcases by movement of the outer ends of the opposed pairs of pistons. The positive volume differential advances sequentially in a direction opposite to crankshaft revolution, and the ends of the cylinder chambers may be interconnected to take advantage of the pressure differential thus created to pump oil around the engine and from one crankcase to the next, e.g., via conduits, represented by dashed line 100 in FIG. 21A.

The engine described in the preferred embodiment has the same bore and stroke for both pump and power sections. However, it is realized that the bore and stroke on the pump section may differ from that of the power section without substantially affecting construction or operation of the engine of the invention.

Also, it is recognized that the triangular bank of pump cylinder-piston assemblies may be employed without operative association with a bank of power cylinder-piston assemblies to provide a two-stroke cycle pump three-stroke cycle pump effect according to the invention.

What is claimed is:

1. A two-stroke cycle engine having three-stroke cycle engine effect comprising:

at least one set of first, second and third two-stroke cycle power cylinder-piston assemblies, each said power cylinder-piston assembly incorporating two, horizontally opposed, reciprocating pistons, said set of power cylinder-piston assemblies arranged in triangular configuration and connected with each other so as to operate in synchronization with each other with a phase difference of about 120° therebetween;

operatively associated with each said set of power cylinder-piston assemblies, an integral set of first, second and third pump cylinder-piston assemblies, each said pump cylinder-piston assembly incorporating two horizontally opposed, reciprocating pistons so as to define a central pump chamber, said set of pump cylinder-piston assemblies arranged in triangular configuration and driven by said set of power cylinder-piston assemblies in synchronization therewith with a phase difference;

each said power cylinder having an inlet port adjacent an axial end and an exhaust port adjacent an axial end for flow of exhaust gas from said cylinder during exhaust-recharge stroke, and each said pump cylinder having first and second ports, each said port adjacent an axial end of said cylinder, and a third port adjacent the mid-section of said cylinder, ignition means associated with each said power cylinder-piston assembly;

fluid manifold means interconnecting ports of said power and pump cylinders for flow of fluid therebetween;

a set of first, second and third crank mechanisms operatively associated with pistons disposed within adjacent axial ends of pairs of said power cylinder-piston assemblies and pairs of said pump cylinder-piston assemblies; and timing means for drivingly connecting said set of crank mechanisms with each other so as to rotate in the same direction in synchronization with each other.

2. The engine of claim 1 wherein said fluid manifold means comprises first conduit means connected to each said first port of each said pump cylinder for passage of fluid in sequence into said central pump chamber of said pump cylinder-piston assembly when the said first port of each said pump cylinder-piston assembly is open by movement of said opposed pistons therewithin, second conduit means connecting a second port of each said pump cylinder to a third port of an adjacent pump cylinder-piston assembly when the second port of said first pump cylinder-piston assembly is opened by movement of said opposed pistons therewithin, and to an inlet port of a said power cylinder-piston assembly.

3. The engine of claim 2 further comprising a carburetor means, said first conduit means connecting said carburetor means to at least one said first port of a said pump cylinder for passage of gas-fuel mixture therebetween.

4. The engine of claim 2 further comprising flow control valves in at least one of said second conduit means, a said valve adapted for short-circuiting fuel-gas mixture flow toward a power cylinder-piston assembly to an adjacent pump cylinder-piston assembly for reduced power operation.

5. The engine of claim 1 wherein the triangular configuration of said set of power cylinder-piston assemblies is an equilateral triangle.

6. The engine of claim 1 wherein the triangular configuration of said set of pump cylinder-piston assemblies is an equilateral triangle.

7. The engine of claim 1 further comprising cooling means associated with said cylinder-piston assemblies.

8. The engine of claim 7 wherein said cooling means comprises fins disposed about one or more of said cylinders for flow of cooling fluid thereabout.

9. The engine of claim 1 wherein said crank mechanisms are housed within crankcases provided for containment of lubricating fluid about moving parts of said engine.

10. The engine of claim 9 wherein the pistons disposed in said cylinder-piston assemblies have rear surfaces defining end pump chambers within axial end segments of said cylinders, and said engine further comprises conduit means interconnecting said crankcases for flow of lubricating fluid therebetween, whereby reciprocating movement of said pistons creates a pressure differential between adjacent crankcases that advances sequentially for pumping lubricating fluid between said crankcases.

11. The engine of claim 1 wherein said first, second and third pump cylinder-piston assemblies are valveless.

12. The engine of claim 1 wherein said inlet port and said outlet port of each said power cylinder are disposed adjacent opposite axial ends of said power cylinder for axial scavenging flow of exhaust gas from said cylinder during exhaust-recharge stroke.

13. The engine of claim 12 wherein said inlet ports in said power cylinders have the form of circumferentially-extending grooves of limited arcuate extent for providing scavenging flow of fluid having a circumferential component within said cylinders.

14. The engine of claim 1 wherein the triangular configuration of said set of pump cylinder-piston assemblies coincides with the triangular configuration of said set of power cylinder-piston assemblies.

15. The engine of claim 1 wherein said first and second ports of each said pump cylinder are disposed adjacent opposite ends of said pump cylinder-piston assembly for axial flow of fluid therebetween.

16. A two-stroke cycle pump having three-stroke cycle pump effect comprising:

at least one set of first, second and third pump cylinder-piston assemblies, each said pump cylinder-piston assembly incorporating two, horizontally opposed, reciprocating pistons, in a manner to define a central pump chamber, said set of pump cylinder-piston assemblies arranged in triangular configuration and connected with each other so as to operate in synchronization with each other with a phase difference of about 120° therebetween, each said pump cylinder having first and second ports adjacent axial ends of said cylinder and a third port adjacent the mid-section of said cylinder;

fluid manifold means interconnecting ports of said pump cylinders for flow of fluid therebetween comprising first conduit means connected to each said first port of each said pump cylinder for passage of fluid in sequence into said central pump chamber of said pump cylinder-piston assembly when the said first port of each said pump cylinder-piston assembly is open by movement of said opposed pistons therewithin, second conduit means connecting the second port of each said pump cylinder to said third port of an adjacent pump cylinder-piston assembly when the second port of said first pump cylinder-piston assembly is opened by movement of said opposed pistons therewithin, and to an outlet;

valve means disposed in said second conduit means between said third port and said outlet for limiting flow of said fluid to the direction toward said outlet;

a set of first, second and third crank means operatively associated with pistons disposed within adjacent axial ends of pairs of said pump cylinder-piston assemblies; and timing means for drivingly connecting said set of crank mechanisms with each other so as to rotate in the same direction in synchronization with each other.

17. The pump of claim 16 wherein the triangular configuration of said set of pump cylinder-piston assemblies is an equilateral triangle.

18. The pump of claim 16 wherein said first and second ports of each said cylinder are disposed adjacent opposite ends of said pump cylinder-piston assembly for axial flow of fluid therebetween.

19. The pump of claim 16 wherein said crank mechanisms are housed within crankcases provided for containment of lubricating fluid about moving parts of said engine.

20. The pump of claim 19 wherein the pistons disposed in said cylinder-piston assemblies have rear surfaces defining end pump chambers within axial end segments of said cylinders, and said engine further comprises conduit means interconnecting said crankcases for flow of lubricating fluid therebetween, whereby reciprocating movement of said pistons creates a pressure differential between adjacent crankcases that advances sequentially for pumping lubricating fluid between said crankcases.

* * * * *

UNITED STATES PATENT AND TRADEMARK OFFICE

CERTIFICATE OF CORRECTION

PATENT NO. : 4,834,032

DATED : May 30, 1989

INVENTOR(S) : Joseph E. Brennan

It is certified that error appears in the above-identified patent and that said Letters Patent is hereby corrected as shown below:

Col. 5, line 40, "stressed" should be --stresses--.

Col. 5, line 67, insert --16-- after "FIG.".

Col. 6, line 51, "120" should be --120°--.

Col. 6, line 59, "Position" should be --position--.

Col. 7, line 47, "or" should be --of--.

Col. 8, line 5, insert --having-- before "three-stroke".

Signed and Sealed this

Eighth Day of May, 1990

*Attest:*

HARRY F. MANBECK, JR.

*Attesting Officer*

*Commissioner of Patents and Trademarks*